US006598937B2

(12) United States Patent
Caruso et al.

(10) Patent No.: US 6,598,937 B2
(45) Date of Patent: Jul. 29, 2003

(54) ADJUSTABLE BACKREST

(75) Inventors: Jerome C. Caruso, Lake Forest, IL (US); Steven J. Caruso, Antioch, IL (US); Bruce R. Gezon, Caledonia, MI (US); Marc A. Gierz, Hudsonville, MI (US); Jack R. Nyenhuis, Jenison, MI (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 10/140,440

(22) Filed: May 6, 2002

(65) Prior Publication Data

US 2002/0195856 A1 Dec. 26, 2002

Related U.S. Application Data

(60) Continuation of application No. 09/833,311, filed on Apr. 11, 2001, now Pat. No. 6,386,636, which is a division of application No. 09/234,291, filed on Jan. 20, 1999, now Pat. No. 6,250,715.

(60) Provisional application No. 60/078,938, filed on Mar. 20, 1998, and provisional application No. 60/072,111, filed on Jan. 21, 1998.

(51) Int. Cl.[7] ..... A47C 1/022

(52) U.S. Cl. ..... 297/353; 297/284.7

(58) Field of Search ..... 297/284.7, 353, 297/411.36

(56) References Cited

U.S. PATENT DOCUMENTS

| | | | |
|---|---|---|---|
| 416,324 | A | 12/1889 | Cross |
| 581,986 | A | 5/1897 | Gould |
| 979,149 | A | 12/1910 | Gay |
| 1,721,221 | A | 7/1929 | Jauregui |
| 2,063,732 | A | 12/1936 | Gailey |
| 2,083,838 | A | 6/1937 | Goenen |
| 2,410,871 | A | 11/1946 | Fields et al. |
| 2,560,791 | A | 7/1951 | Fincher et al. |
| 2,584,732 | A | 2/1952 | Okun |
| 2,592,702 | A | 4/1952 | Sprung |
| 2,603,275 | A | 7/1952 | Kuebler |
| 2,720,912 | A | 10/1955 | Light |
| 3,215,470 | A | 11/1965 | Swenson et al. |
| 3,382,000 | A | 5/1968 | Sully |
| 4,043,592 | A | 8/1977 | Fries |
| 4,145,020 | A | 3/1979 | Webster |
| 4,154,477 | A | 5/1979 | Swenson et al. |
| 4,155,593 | A | 5/1979 | Swenson et al. |
| 4,156,544 | A | 5/1979 | Swenson et al. |
| 4,165,901 | A | 8/1979 | Swenson et al. |
| 4,181,357 | A | 1/1980 | Swenson et al. |
| 4,239,282 | A | 12/1980 | White |
| 4,244,623 | A | 1/1981 | Hall et al. |
| 4,384,742 | A | 5/1983 | Wisniewski |
| 4,451,084 | A | 5/1984 | Seeley |

(List continued on next page.)

FOREIGN PATENT DOCUMENTS

| | | |
|---|---|---|
| WO | WO 93/25121 | 12/1993 |

OTHER PUBLICATIONS

Sudjic, Deyan, "Have these men designed the most comfortable chair in the world?", Blueprint, Oct. 1994, 29–36.

*Primary Examiner*—Peter R. Brown
(74) *Attorney, Agent, or Firm*—Brinks Hofer Gilson & Lione

(57) ABSTRACT

An adjustable backrest for a seating structure includes an upright having a rack. The backrest is moveably mounted on the upright. A pawl is pivotally mounted to the backrest about a pivot axis and is pivotable between an engaged position, wherein the pawl is engaged with the rack, and a disengaged position, wherein the pawl is disengaged from the rack. The pawl is further translatably mounted to the backrest, wherein the pawl is translatable relative to the backrest between at least a disabled position and an operative position. A spring biases the pawl into the engaged position when the pawl is in the operative position. A method of adjusting the height of the backrest is also provided.

13 Claims, 26 Drawing Sheets

U.S. PATENT DOCUMENTS 4,621,864 A 11/1986 Hill
4,639,039 A 1/1987 Donovan
4,647,109 A 3/1987 Christophersen et al.
4,660,885 A 4/1987 Suhr et al.
4,662,681 A 5/1987 Favaretto
4,709,961 A 12/1987 Hill
4,709,963 A 12/1987 Uecker et al.
4,732,423 A 3/1988 Condon
4,749,230 A 6/1988 Tornero
4,786,108 A 11/1988 Dauphin
4,872,727 A 10/1989 Rye
4,951,995 A 8/1990 Teppo et al.
5,007,678 A 4/1991 DeKraker
5,037,158 A 8/1991 Crawford
5,050,933 A 9/1991 Tornero et al.
5,127,621 A 7/1992 Uecker et al.
5,176,356 A 1/1993 Lorbiecki et al.
5,242,138 A 9/1993 Kornberg
5,265,938 A 11/1993 Melhuish et al.
5,312,160 A 5/1994 Davis et al.
5,318,347 A 6/1994 Tseng
5,324,096 A 6/1994 Schultz
5,326,154 A 7/1994 Williamson et al.
5,346,284 A 9/1994 Dauphin
5,368,365 A 11/1994 Feldberg
5,388,892 A 2/1995 Tornero
5,393,124 A 2/1995 Neil
5,393,125 A 2/1995 Watson et al.
5,425,566 A 6/1995 Buchacz
5,435,626 A 7/1995 Lai
5,439,267 A 8/1995 Peterson et al.
5,547,253 A 8/1996 Schwartz et al.
5,588,766 A 12/1996 Lai
5,599,067 A 2/1997 Schuelke et al.
5,649,741 A * 7/1997 Beggs ..... 297/353
5,685,609 A * 11/1997 Miotto ..... 297/353
5,735,577 A * 4/1998 Lin ..... 297/411.36

* cited by examiner 388
394
390

290
286
294
292
288
276
274
284
278
280
272
270

55
290
276
270
55

290
270
272
292
286
284
280
282
278
294
276

ADJUSTABLE BACKREST

This application is a continuation of U.S. application Ser. No. 09/833,311, filed Apr. 11, 2001, now U.S. Pat. No. 6,386,636 which is a division of U.S. application Ser. No. 09/234,291, filed Jan. 20, 1999, now U.S. Pat. No. 6,250,715 which claims the benefit of U.S. provisional application Ser. No. 60/072,111, filed Jan. 21, 1998 and U.S. provisional application Ser. No. 60/078,938, filed Mar. 20, 1998, which applications are hereby incorporated herein by reference.

BACKGROUND OF THE INVENTION

The present invention relates generally to tiltable chairs, and in particular, to a synchrotilt chair having an adjustable seat, backrest and armrests.

Chairs of the type typically used in offices and the like are usually configured to allow tilting of the seat and backrest as a unit, or to permit tilting of the backrest relative to the seat. In chairs having a backrest pivotally attached to a seat in a conventional manner, the movement of the backrest relative to the seat can create shear forces which act on the legs and back of the user, and which can also create an uncomfortable pulling of the user's shirt, commonly called "shirt-pull."

To enhance the user's comfort and to promote ergonomically healthy seating, synchro-tilt chairs provide for the seat and backrest to tilt simultaneously, but at different rates, preferably with the back tilting at a greater rate than the seat. Normally, synchro-tilt chairs employ compression and/or tension springs, torsion springs and/or torsion bars to bias the seat and back upwardly and to counterbalance the rearward tilting of the user. Chairs using these types of springs can have various limitations associated with the type of spring used therein.

For example, the proper placement of compression springs and/or torsion springs within the chair can often require a large or bulky housing with associated aesthetic limitations. Moreover, the ride, or resistive force experienced by the user, may be unsatisfactory because spring rates associated with compression springs are not linear and tend to increase as the spring bottoms out. In addition, the cost of manufacturing the chair, due to the placement of the springs and the introduction of additional load bearing elements, can be increased. This problem can be exacerbated when two or more springs are used in the chair. Moreover, synchrotilt chairs typically provide for the spring to act on one of the seat or back support, and for the force to then be transferred to the other through a pivotal attachment, which can require additional load carrying capabilities.

Furthermore, inconsistencies in the performance of compression and torsion springs, and the longevity thereof, can often be traced to the inherent properties of steel, which is typically used to make such springs. For example, steel is subjected to the problem of "creep" and various inconsistencies introduced during the manufacture of the steel and the subsequent heat-treating processes. Moreover, because of the requisite size of the springs, the mechanisms used to adjust the amount of initial resistive compression can be difficult to activate, and can be progressively more difficult to adjust as higher settings are reached.

Chairs employing torsion bars may experience similar limitations. For example, the length and diameter of the bar is dictated by the range of movement and force output desired, and the desire to avoid overstressing the spring. Often, relatively heavy and highly stressed bars of great length are required to provide the control necessary to adequately support a user. Thus, the shape and associated aesthetics of the chair are dictated by the size of the spring. In addition, the chair must be provided with load-bearing elements at the ends of the bar and at the point of adjustment. Moreover, as with compression and torsion springs, activation or adjustment mechanisms used to achieve a desired initial pretorque setting can be difficult to manipulate, and can become increasingly so as higher settings are reached.

Leaf springs can also be used to support the user in the chair. However, leaf springs are typically clamped at one or more ends of the spring, usually by passing a bolt or like fastener through the spring. This is especially true when the leaf spring is configured as a cantilever similar to a diving board. Holes in the spring can introduce stress risers, however, and clamping one or more ends, as opposed to having them simply supported, introduces indeterminate moments and resultant stresses in the spring which may not be evenly distributed. Moreover, the resistive force of many leaf springs, including cantilevered springs, is often adjusted by varying the prestress of the spring through bending As with the other springs described above, such an adjustment mechanism can be difficult to activate, and becomes progressively more so as higher settings are reached.

It is also desirable to provide a chair that can be adjusted to accommodate the various needs and sizes of the user. In particular, it is desirable to provide a chair having an adjustable backrest, adjustable armrests, and an adjustable seat depth.

The typical approach to adjustably supporting a backrest is to provide a single, centered spline, which can be located internally or externally to the backrest cushion, or like support. Typically, such a spline is linear so as to allow for adjustment of the backrest. However, it is often desirable to provide contours in the backrest of the chair so as to conform to the shape of the user's back. When the spline is located inside the backrest, the assembly is necessarily thick to accommodate the spline and desired contour. In addition, the backrest must itself be structural, and securely attached to the spline with tight tolerances, to provide lateral support for the user on the outer edges of the backrest and to avoid a feeling of sloppiness. Moreover, if armrests are desired, they must typically be positioned on separate supports projecting from the seat or from beneath the chair, since the spline centered backrest is usually structurally unable to support the large loads imparted on the armrests by a user along the sides of the backrest. When adjustable, such armrest supports often house complex and expensive to manufacture height adjustment mechanisms.

Furthermore, synchrotilt chairs typically provide pivot axes and links along the sides of the chair. Mechanically, there is an advantage to give the driven links input (occupant) and output forces (e.g., springs) as great a relative "stance" as possible. As a result, the use of a centered spline can result in a control that feels less "lively" when the occupant is not centered. Additionally, centered spline chairs often provide an adjustment mechanism adjacent the spline at the center of the back, which can be difficult to access, especially by a seated occupant when the backrest is in a lowermost position.

SUMMARY OF THE INVENTION

Briefly stated, the invention is directed to an improved synchrotilt chair having an improved tilt control mechanism and an adjustable backrest, armrests and seat.

In one aspect of the invention, the chair includes a housing, a back support pivotally connected to the housing about a first horizontal axis and a seat support pivotally connected the housing about a second horizontal axis. A leaf spring includes a first end engaging a forward portion of the housing and a second end biasing the seat support and the back support in an upward direction. A fulcrum member is moveably supported in the housing and engages the leaf spring between its first and second end. In operation, the fulcrum member can be easily moved longitudinally within the housing so as to vary the length of the leaf spring lever arm and thereby vary the amount of resistive force supporting the user.

In a preferred embodiment, the seat support is also slideably connected to the housing about the second horizontal axis and is pivotally connected to the back support about a third horizontal axis.

In another aspect of the invention, a seat having a seat pan is adjustably mounted on the seat support. In operation, the seat can be moved in a longitudinal direction to adjust the depth of the seat relative to the backrest and thereafter releasably locked to the seat support.

In yet another aspect of the invention, a tilt limiter is provided to limit the rearward tilting of the chair. The tilt limiter includes a cam member pivotally mounted in the housing and having a plurality of teeth which engage a rack, or plurality of laterally oriented grooves, formed in the seat support. In operation, the cain member can be pivoted to limit the rearward tilting of the user In another aspect of the invention, a selector member is connected to the tilt limiter. The selector member includes indicia that indicates the setting of tile tilt limiter so as to apprise the user of the maximum rearward tilt position of the seat, or chair, even when the seat or chair is in a tilt position other than the maximum rearward tilt position. In a preferred embodiment, the selector member comprises a handle connected to the cam member. The handle preferably has an substantially flat elongated portion forming the indicia such that the angular orientation of the substantially flat elongated portion indicates the setting of the tilt limiter, and the corresponding maximum rearward tilt position of the seat and chair.

In another aspect of the invention, the back support includes a pair of uprights extending upwardly along opposite sides of the chair. Each upright includes a first and second bar mounted thereto in a parallel and spaced apart relationship with the other. A backrest is slideably mounted on the first bar members and an armrest is slideably mounted to each of the second bar members. Preferably, the uprights are located externally of the backrest and are connected with a cross member so as to form a one-piece back support.

In a preferred embodiment, an engagement member is mounted to a bracket member which is mounted on the first bar member. The engagement member is adapted to engage a rack located on the upright to thereby releasably secure the backrest to the uprights. The armrest preferably includes a locking device which is adapted to engage the second bar member and thereby releasably secure the armrest to the upright.

The present invention provides significant advantages over other synchrotilt chairs, and chairs having adjustable backrests and armrests. For example, in the most preferred embodiment, an improved tilt control mechanism is provided which can be manufactured in a compact and aesthetically pleasing housing. In particular, the leaf spring, or preferably a pair thereof, extends longitudinally within the housing, which can be made in a compact and aesthetically pleasing form with little or no depth due to the nature of the spring. The width of the housing also need not be dictated by length of the spring. The resistive force of the leaf springs is easily and simply adjusted by moving the fulcrum member longitudinally within the housing. Consequently, the springs are not prestressed at differing levels, and the adjustment member can be easily manipulated without progressive difficulty The leaf spring also provides a relatively uniform spring rate throughout the tilting range of the chair.

The leaf springs also are preferably made of composite material, which is more resistant to creep. The leaf spring preferably supports a shaft pivotally connecting the seat support and back support. In this way, the leaf spring biases both members upwardly together, rather than acting on one member with the force then transmitted to the other member through a pivotal attachment. As such, the number of load bearing elements are reduced and simplified.

The three bar slide mechanism also provides several advantages. For example, the linkage provides for a synchrotilt chair wherein the back tilts at a greater rate than the seat, but avoids the use of a fourth bar, which can add to the complexity and manufacturing costs of the chair. Indeed, the overall design is greatly simplified by forming "bars" out of the housing, seat support and back support. Additionally, the use of a slide member allows for the assembly to be made in a more compact and aesthetically pleasing form.

The unique back support also provides many advantages. For example, by providing a one-piece back support, a simplified and aesthetically pleasing structure is provided, which also performs the combined tasks of forming one of the bars of the linkage assembly, providing a support for the backrest and providing a support for the armrests. Additionally, the exoskeletal nature of the back support framing a cushion gives the user a strong visual of support, security and durability. Moreover, by providing uprights along the sides of the chair, the backrest is not required to be structural in nature, and the loads imparted by a user against the side of the backrest can be transmitted directly through the forwardly extending arms of the back support to the housing and spring member so as to provide a more "lively" control for the user. Moreover, since the backrest is supported on both sides, looser tolerances can be accommodated during the assembly of the backrest without sacrificing any tightness in the feel of the backrest.

The uprights can also be used to also support the armrests, which thereby avoids the need for separate supports and complex mechanisms. In this regard, the bar members, which are mounted to the uprights, provide a simple but sturdy support for the backrest and armrests.

The present invention, together with further objects and advantages, will be best understood by reference to the following detailed description taken in conjunction with the accompanying drawings.

DETAILED DESCRIPTION OF THE PRESENTLY PREFERRED EMBODIMENTS

The terms "longitudinal" and "lateral" as used herein are intended to indicate the direction of the chair from front to back and from side to side, respectively. Similarly, the terms "front", "side", "back", "forwardly", "rearwardly", "upwardly" and "downwardly" as used herein are intended to indicate the various directions and portions of the chair as normally understood when viewed from the perspective of a user sitting in the chair.

Figure 1:
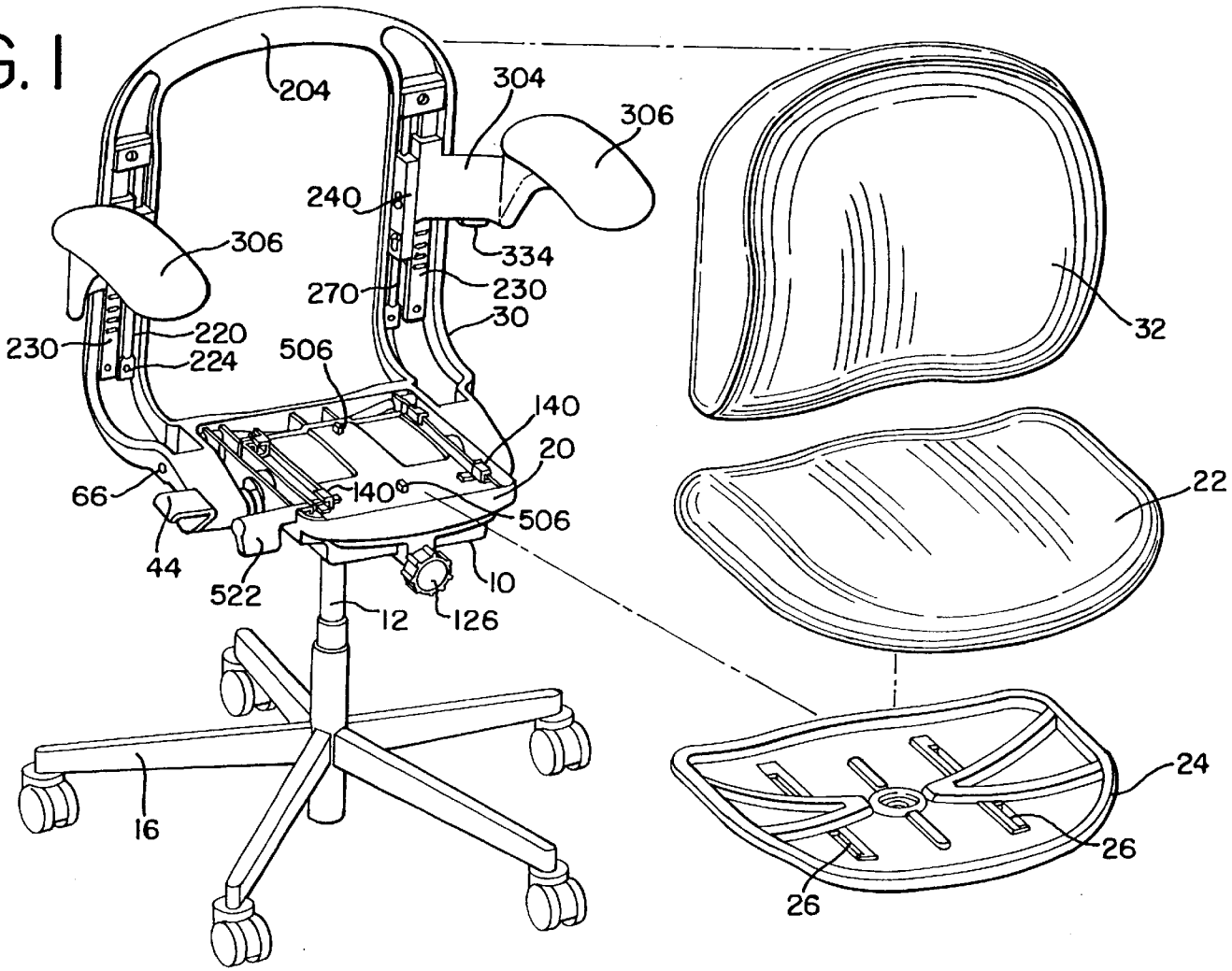
FIG. 1 is a front perspective of the chair with the backrest, seat cushion and seat pan shown in an exploded format.
Figure 4:
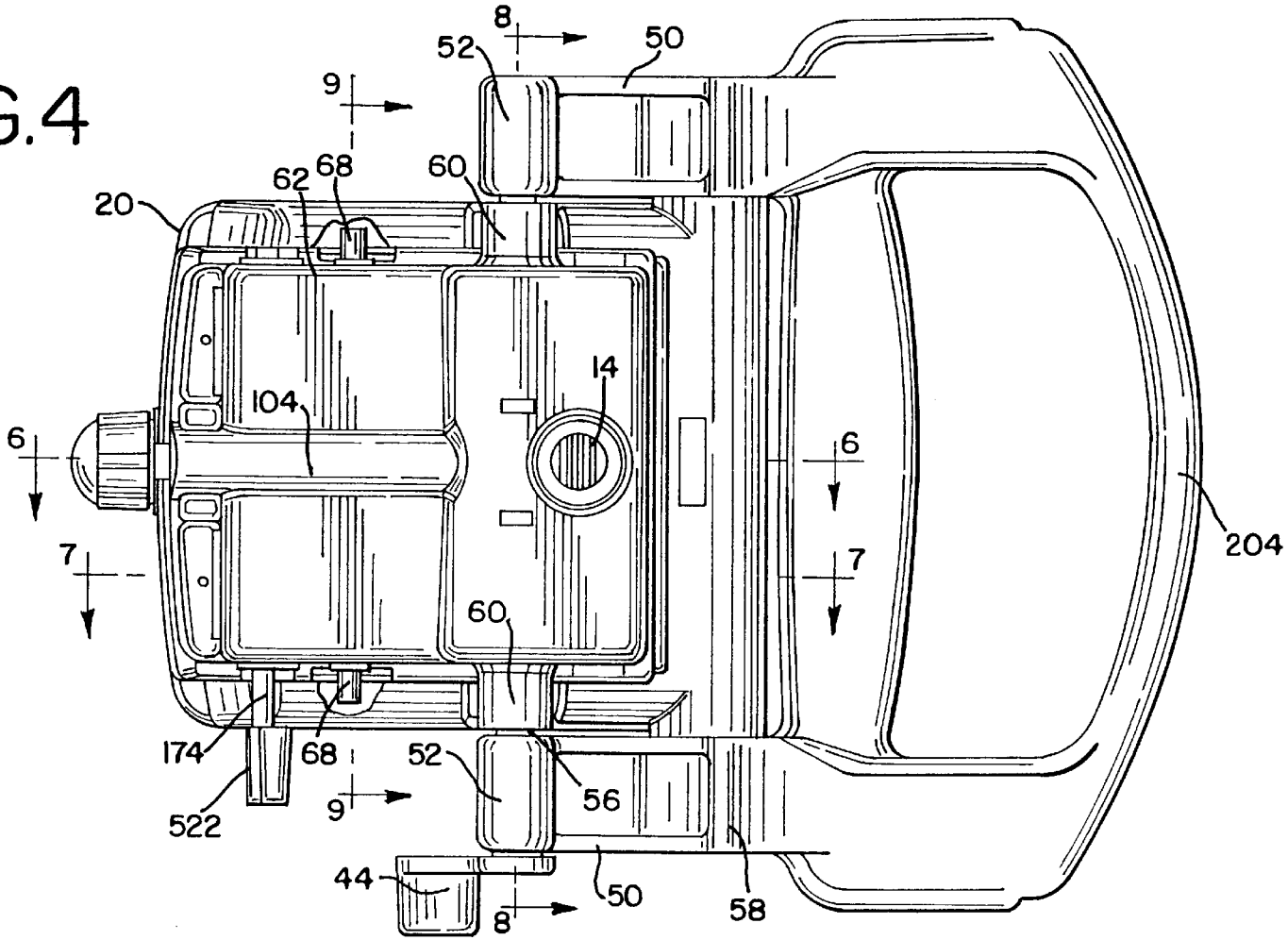
FIG. 4 is a partial bottom view of the chair taken along line 4—4 of FIG. 3 without armrests applied thereto.
Figure 6:
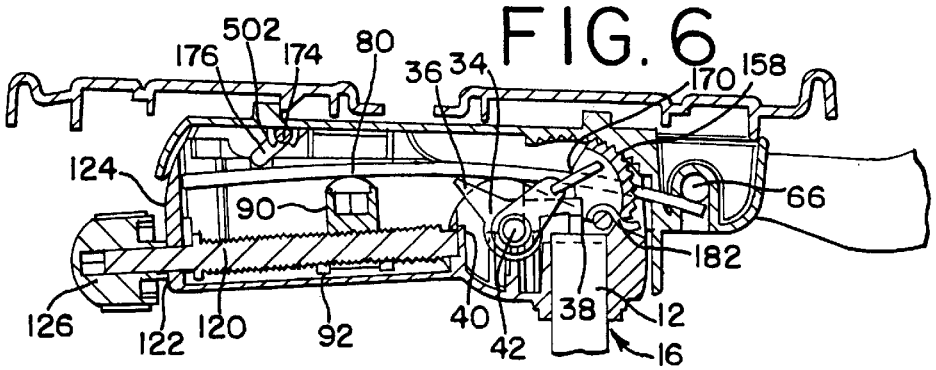
FIG. 6 is a cross-sectional view taken along line 6—6 of FIG. 4
Figure 19:
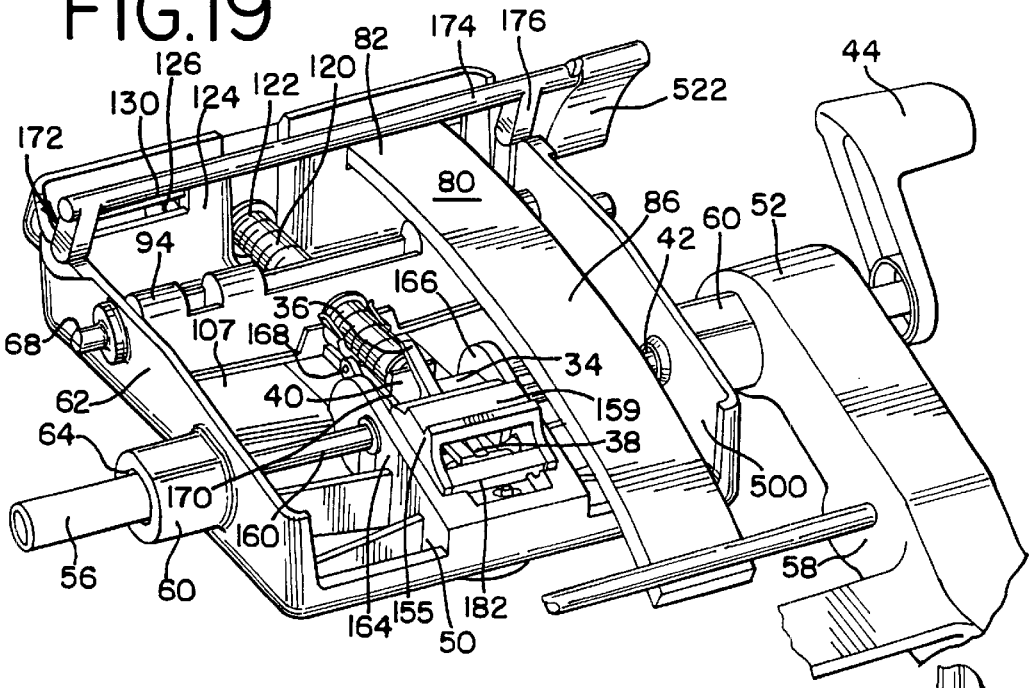
FIG. 19 is a perspective view of the housing with a fulcrum member, one of the leaf springs and the tilt limiter applied thereto.
Figure 20:
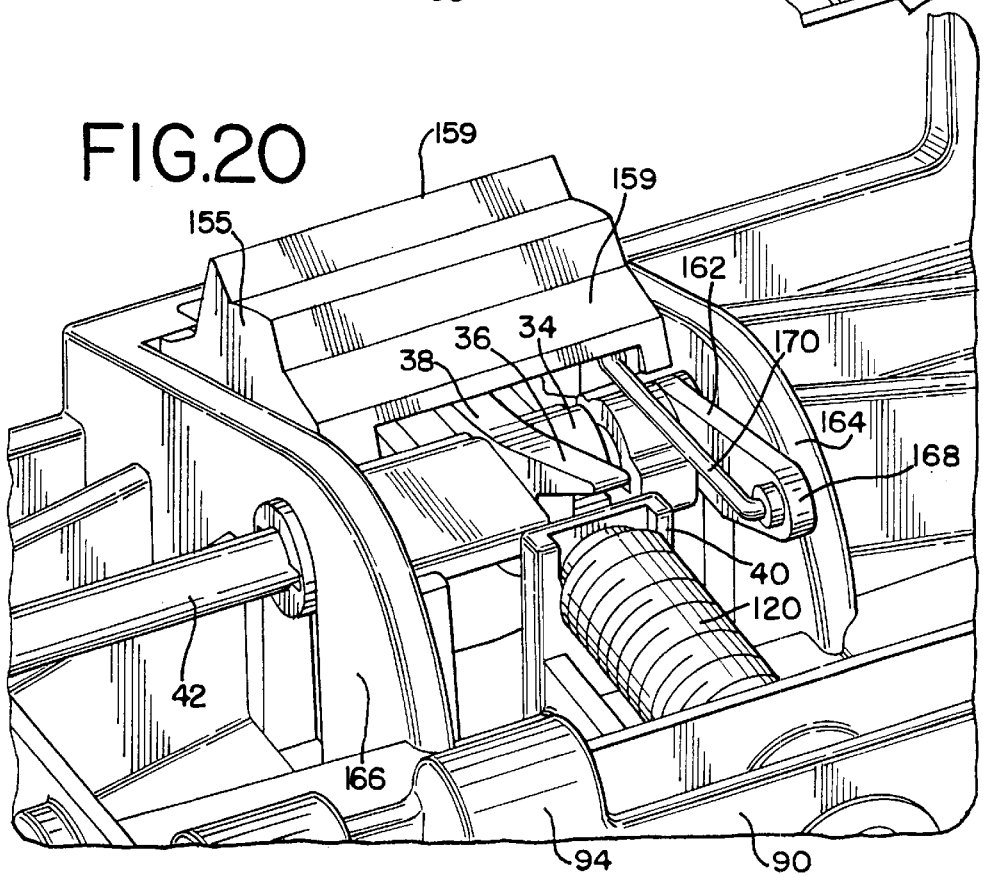
FIG. 20 is a partial rear perspective view of the tilt limiter and pneumatic cylinder adjustment mechanism.
Figure 21:
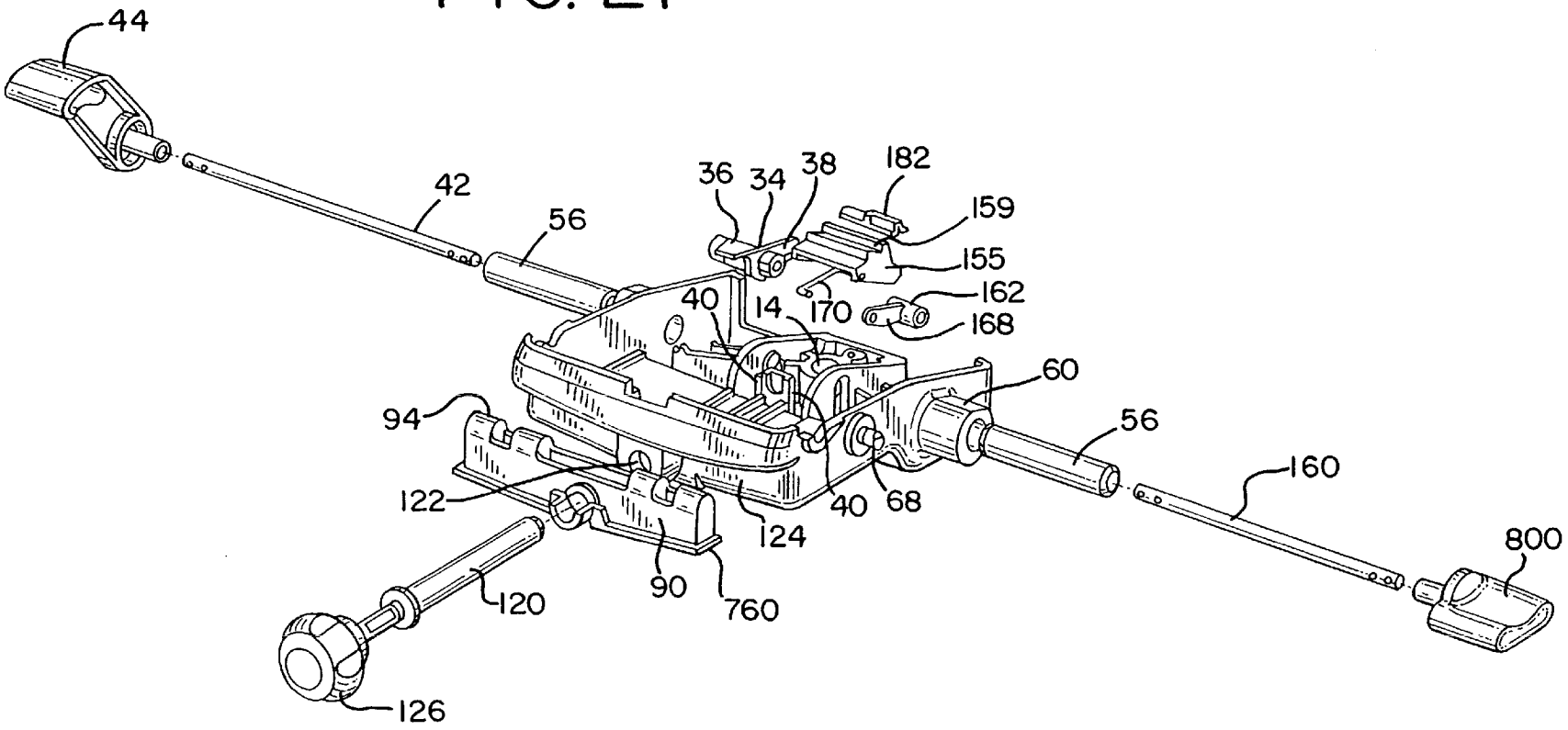
FIG. 21 is an exploded view of the tilt mechanism.
Figure 22:
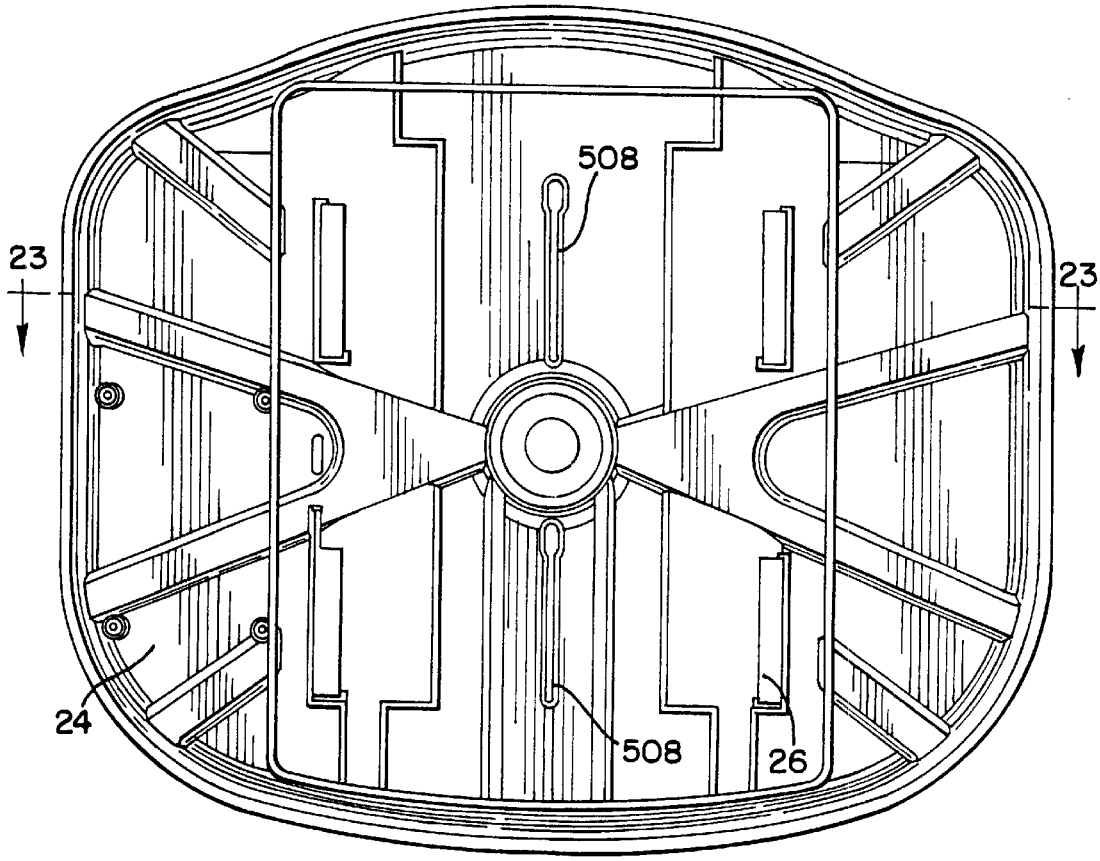
FIG. 22 is a bottom view of the seat pan.

Referring to the drawings, FIG. 1 shows a preferred embodiment of the chair having tilt control housing 10, seat support 20, seat cushion 22, back support 30, backrest 32 and seat pan 24. A pneumatically adjustable support column 12 is mounted to a rear portion of the housing at opening 14 as shown in FIGS. 4 and 6. A top portion of the column 12 having an actuation button extends into the housing. As shown in FIGS. 19–21, a pivot member 34 having a forwardly extending arm 36 engaging a stop 40 and a rearwardly extending arm 38 adapted to engage the actuation button is mounted to a pivot rod 42 by engagement of a key member within a key hole. The pivot rod is rotatably mounted to housing 10 at lug member 166. A handle 44 is mounted to the end of the pivot rod 42. In operation, the handle 44 is rotated so as to rotate the rearwardly extending arm 38 of the pivot member and thereby engage the actuation button, which in turn allows the support column to extend in response to a gas spring contained therein, or to collapse in response to the weight of the user being applied to the seat.

Referring to FIG. 1, a base 16, preferably a five arm base with casters, is mounted to the bottom of the support column 12 in a conventional manner. One of skill in the art would understand that other support columns and bases can be used to support the housing, including fixed height support columns and non-rolling bases.

Figures 3, 3A:
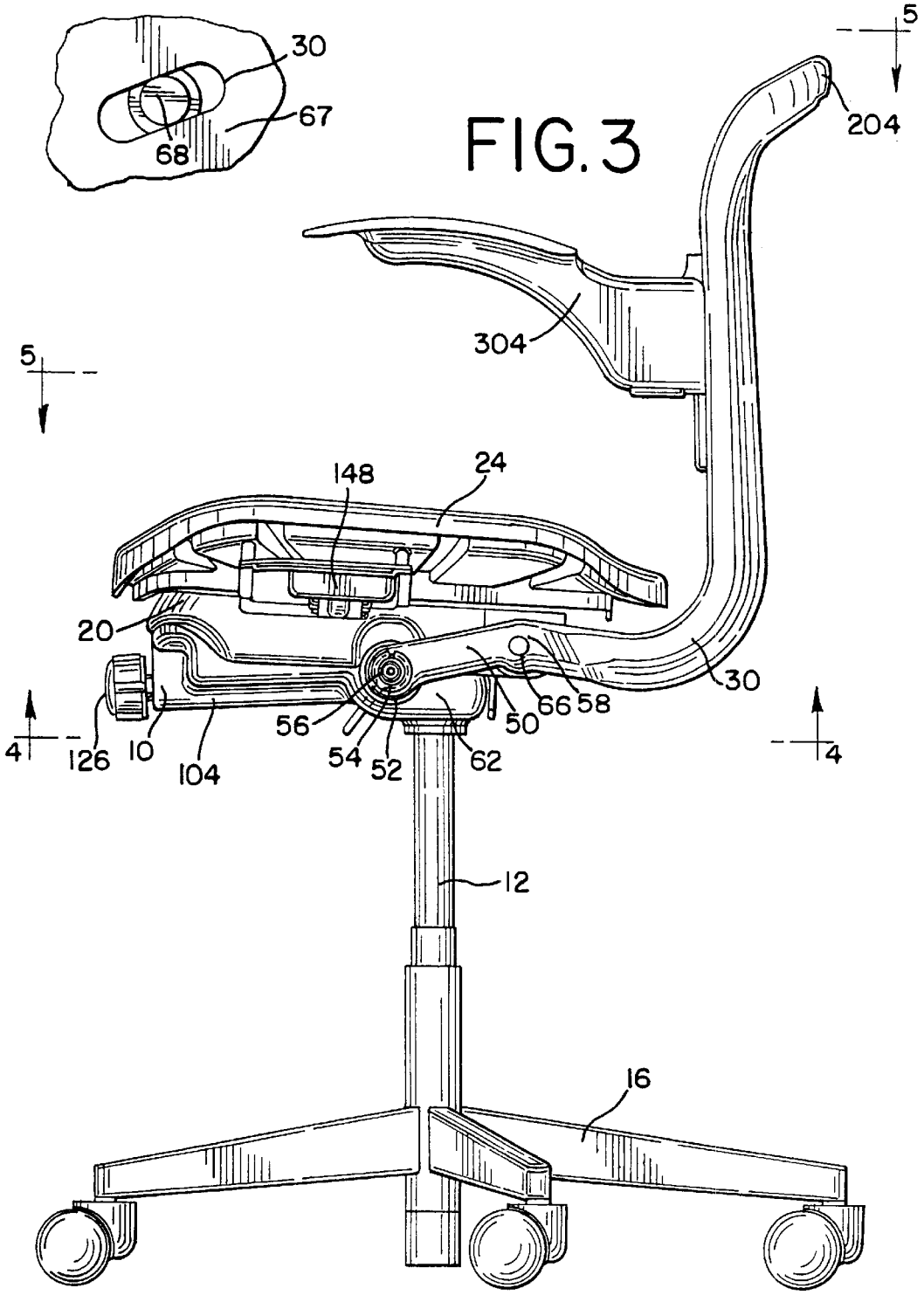
FIG. 3 is a side view of the chair without a backrest, seat cushion or armpads applied thereto.
FIG. 3A is a partial side view of an alternative embodiment of the pivotal connection between the seat support and the housing.
Figure 30:
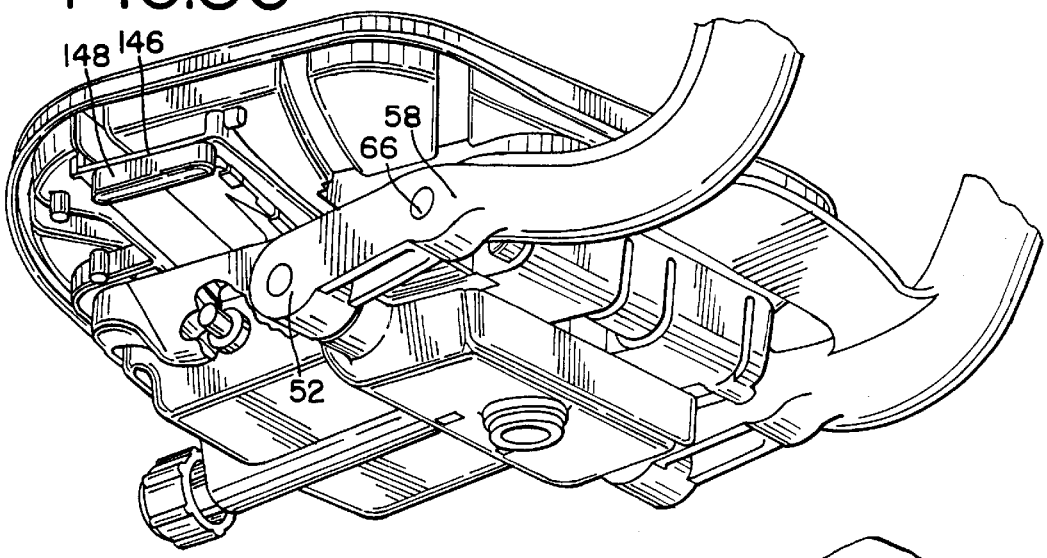
FIG. 30 is a bottom perspective view of the housing, seat support, seat pan and partial back support.

As shown in FIGS. 3 and 4, the back support 30 includes a pair of support arms 50, extending forwardly along opposite sides of the chair. Each of the support arms 50 terminates in a first lug portion 52 having a horizontal opening 54. Referring to FIG. 19, the housing 10 includes a boss 60 extending outwardly from each sidewall 62 of the housing in a perpendicular relationship therewith. The lug portions 52 are pivotally mounted to the bosses 60 on opposite sides of the housing with a pair of hollow pivot rods 56, which are inserted through an opening 64 extending through each boss and which defines a first horizontal pivot axis. The pivot rod 42 for actuating the gas spring extends through and is rotatably mounted in the hollow pivot rod 56. As As shown in FIGS. 3 and 30, each support arm also includes a second lug portion 58 positioned rearwardly of said first lug portion 52. The second lug portions 58 are pivotally connected to the seat support with a pivot rod 66, which define a third horizontal pivot axis, as shown in FIGS. 3 and 4.

Figure 9A:
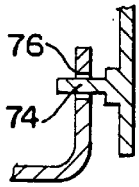
FIG. 9A is a partial cross,sectional view of an alternative embodiment of the connection between the seat support and the housing.
Figure 9:
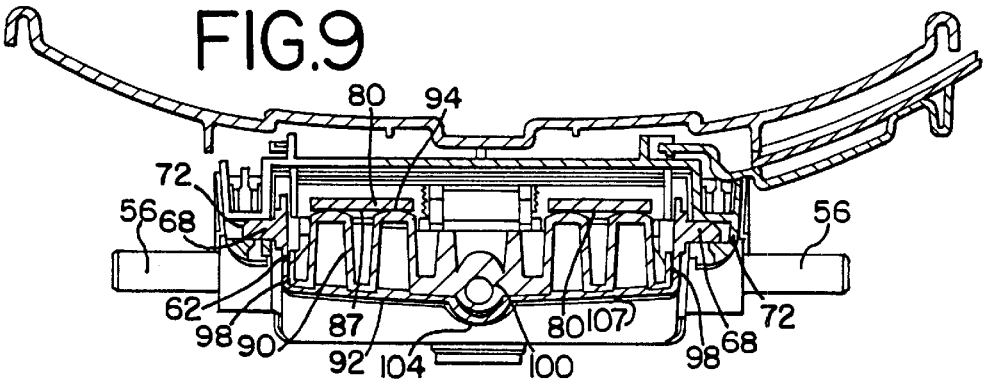
FIG. 9 is a cross-sectional view taken along line 9—9 of FIG. 4 without the back support shown.

Referring to FIG. 4, pivot rod 68 extends outwardly from each sidewall 62 of the housing and defines a second horizontal axis. The seat support 20 is pivotally and slideably connected to the housing at the second horizontal pivot axis by inserting the pivot rods through slots 30 formed in opposite sidewalls 67 of the seat support as shown in FIG. 3A. Alternatively, the pivot rods 68 are disposed in slotted channels 72 formed in each of the sidewalls as shown in FIG. 9. Or, in yet another alternative embodiment, shown in FIG. 9A, pivot rod 74 extends inwardly from the seat support sidewall to engage a slot 76 formed in the sidewall of the housing. In a preferred embodiment, the second horizontal pivot axis 68 is positioned forwardly of the first horizontal pivot axis 56, which is positioned forwardly of the third horizontal pivot axis 66.

In operation, the housing 10, seat support 20 and back support 30 form a three-bar linkage with a slide. Because the second pivot axis is positioned forwardly of the first pivot axis which is positioned forwardly of the third pivot axis, the back support 30 tilts rearwardly at a greater rate and angle than does the seat support 20. Preferably, the back to seat inclination is at a ratio of about 2:1. The three-bar linkage provides a simple and compact mechanism which avoids the use of additional links. Additionally, by forming the linkage assembly from the seat support, back support and housing, complex and expensive links and load bearing parts are avoided. When combined with a pair of leaf springs 80, the resultant chair can be designed in a compact and aesthetically pleasing form. It should be understood that the three-bar linkage could be formed by pivotally connecting the seat support and back support to the housing and by pivotally and slideably connecting the seat support to the back support, or by pivotally connecting the seat support to the housing and to the back support and then pivotally and slideably connecting the back support to the housing Although the above-described three-bar mechanism is preferred, it should be understood that the leaf springs can also be incorporated into synchro-tilt chairs using linkage mechanisms such as four-bar linkages and the like. With a four-bar linkage, links can be provided to pivotally connect the seat support and/or back support to the housing and/or to each other about various horizontal axes.

Figure 24:
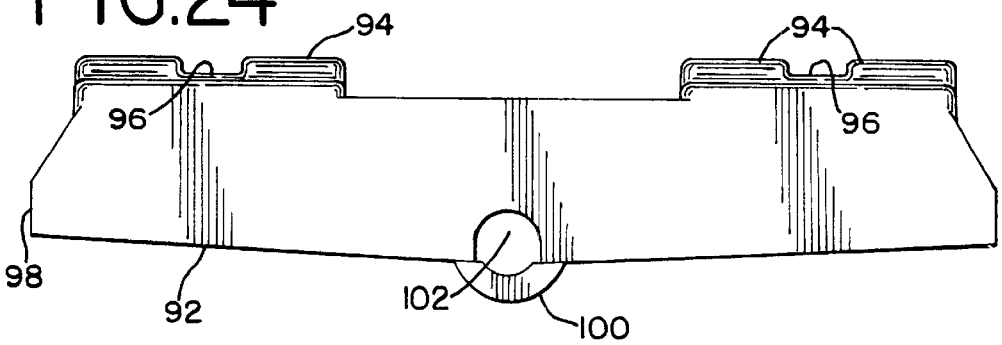
FIG. 24 is a front view of a fulcrum member.
Figure 25:
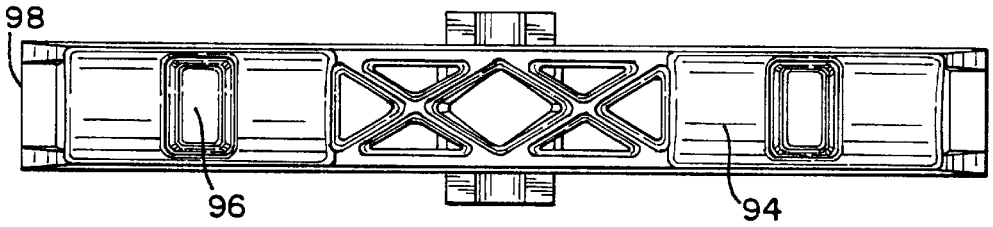
FIG. 25 is a top view of the fulcrum member.

As best shown in FIGS. 6–9, 19 and 27–29. A fulcrum member 90 is moveably installed in the housing 10 beneath the pair of leaf springs 80. The fulcrum member 90 is preferably formed from a single piece of hard, durable material having a relatively low coefficient of friction, such as DELRIN or CELCON Acetal, so as to allow the fulcrum member to slide relatively easily along a bottom surface of the housing, even when heavily loaded by the spring. It should be understood, however, that other materials such as steel would also work. Similarly, the bottom surface can be lined with a material having a low coefficient of friction, such as TEFLON. Referring to FIGS. 24 and 25, the fulcrum member 90 includes a bottom surface 92 and a pair of support pads 94 formed on a top of the fulcrum member.

Preferably, the support pads 94 on each side of the fulcrum member are separated by a groove 96 which reduces the surface area in contact with the spring 80 and the attendant friction forces which act on the spring.

Figure 24A:
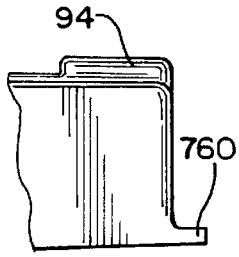
FIG. 24A is a partial front view of an alternative embodiment of the fulcrum member.

The fulcrum member 90 also includes end portions 98 which are tapered outwardly and downwardly from the support pads 94, and a lug portion 100 formed at a bottom center portion of the member. Alternatively, as shown in FIG. 24A, the end portions include a small lip portion 760. The lug portion 100 includes a longitudinally oriented hole 102. In one embodiment, at least a portion of the hole is threaded. Alternatively, a threaded fitting can be inserted into the bore provided in the lug portion, or a entirely separate bracket having a threaded opening can be mounted to a bottom of the fulcrum member.

As shown in FIGS. 5–9 and 19, the fulcrum member 90 is disposed laterally within the housing 10 such that the bottom surface 92 of the fulcrum member slideably engages a pair of longitudinally oriented landings 107 formed along opposite sides of the bottom of the housing. The end portions 98 of the fulcrum member 90 abut the inner surface of the side walls 62 of the housing and act as guides for the fulcrum member as it is moved longitudinally within the housing. Referring to FIG. 9, the lug portion 100 is disposed within a channel 104 longitudinally formed in the housing below and between the landings 102. The lug portion 100 also acts as a guide within the channel 104 so as to maintain the alignment of the fulcrum member within the housing as it moves longitudinally along its path.

Figure 26:
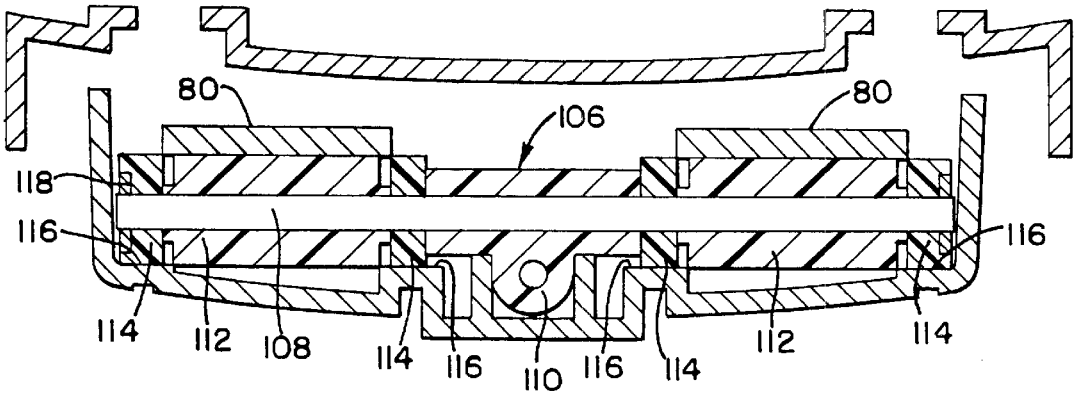
FIG. 26 is a partial sectional view of an alternative embodiment of the fulcrum member supported on the housing.

In an alternative embodiment, shown in FIG. 26, the fulcrum member 106 includes a shaft 108 and a carriage 110 disposed on the shaft. A pair of rollers 112 are rotatably mounted on the shaft 108 so as to be in alignment with the pair of leaf springs 80. Two pairs of support rollers 114 are rotatably mounted on the shaft on opposite sides of each of the rollers 112 in alignment with landings 116 formed on a bottom surface of the housing. In operation, the fulcrum member can be rolled longitudinally within the housing on rollers 114, as rollers 112 engage leaf springs 80. A clip 118, or like retainer, is installed on each end of the shaft to capture and retain the rollers and carriage on the shaft. Preferably, the shaft, rollers and carriage are made of steel.

As illustrated in FIGS. 5, 6 and 16–18, an adjustment member 120, preferably a threaded shaft, is inserted through an opening 122 in a front wall 124 of the housing and is rotatably secured thereto. A knob 126 is mounted on an end of the adjustment member 120 externally of the housing for access by the user. An opposite end of the shaft is rotatably supported by a stop member 40 extending upwardly from the bottom surface of the housing. It should be understood, however, that the end of the shaft need not be supported at all as the fulcrum member is guided by the housing. The shaft threadably engages the opening in the lug portion 100 of the fulcrum member, or an opening in the carriage 110.

It should also be understood that the fulcrum member can be fixed within the housing at a specific location, such that the resistive force of the chair can not be adjusted.

Figure 7:
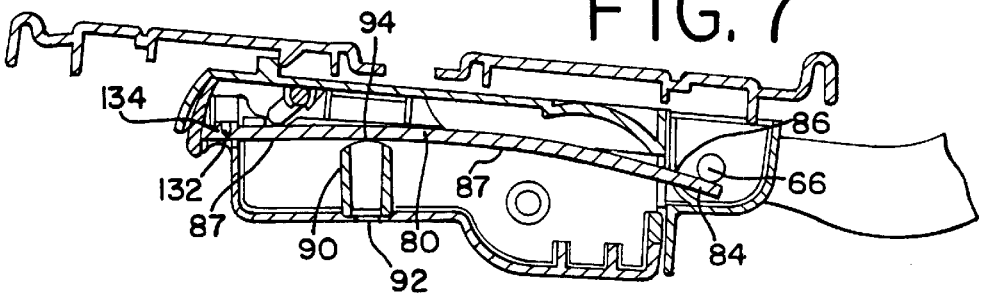
FIG. 7 is a cross-sectional view taken along line 7—7 of FIG. 4.
Figure 27:
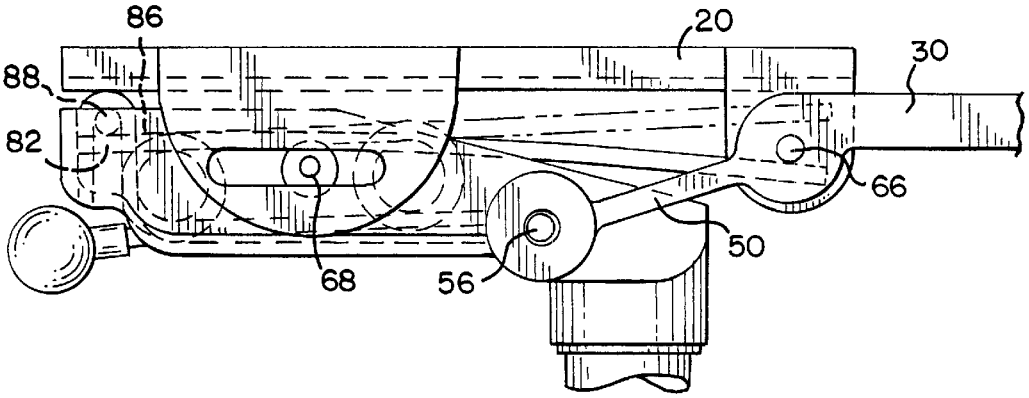
FIG. 27 is a schematic of the tilt mechanisms in an upright position with the leaf spring shown in an unstressed and prestressed positions.
Figure 28:
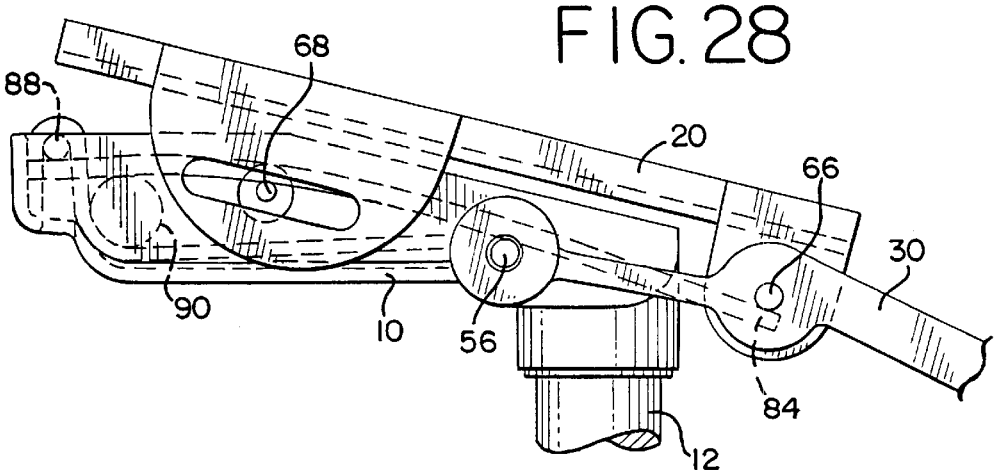
FIG. 28 is a schematic of the tilt mechanism shown in a reclined tilt position with the fulcrum positioned forwardly in the housing.
Figure 29:
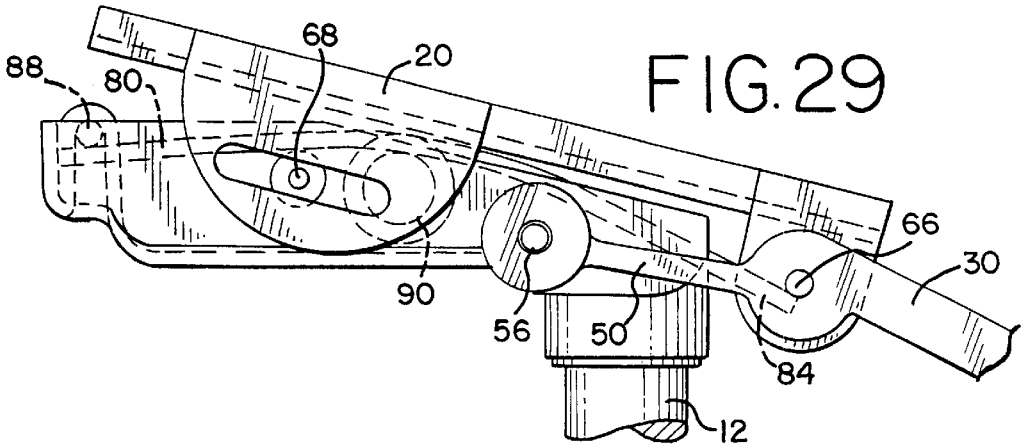
FIG. 29 is a schematic of the tilt mechanism shown in a reclined position with the fulcrum member positioned rearwardly in the housing.

As shown in FIG. 19, the front wall 124 of the housing includes laterally oriented slotted openings 126 formed along opposite sides of the front wall 124 of the housing. Cross members 130 are defined by and formed over tie openings. The pair of leaf springs 80 are installed in the chair by inserting an end 82 of each spring through one of the openings 128 such that a top surface 86 of the spring engages the cross member 130. Alternatively, as shown in FIGS. 27–29, a horizontal rod 88 can be installed laterally in a forward portion of the housing so an to engage the top surface 86 of the forward end 82 of the spring. In one embodiment, a forward edge of the spring abuts the front wall of the housing so as to maintain the longitudinal position of the spring within the housing. Alternatively, as shown in FIG. 7, a protuberance 132 extends downwardly from the cross member 130 and engages a hole 134 or detent formed in a forward portion of the spring so as to maintain the longitudinal position of the spring.

Figure 5:
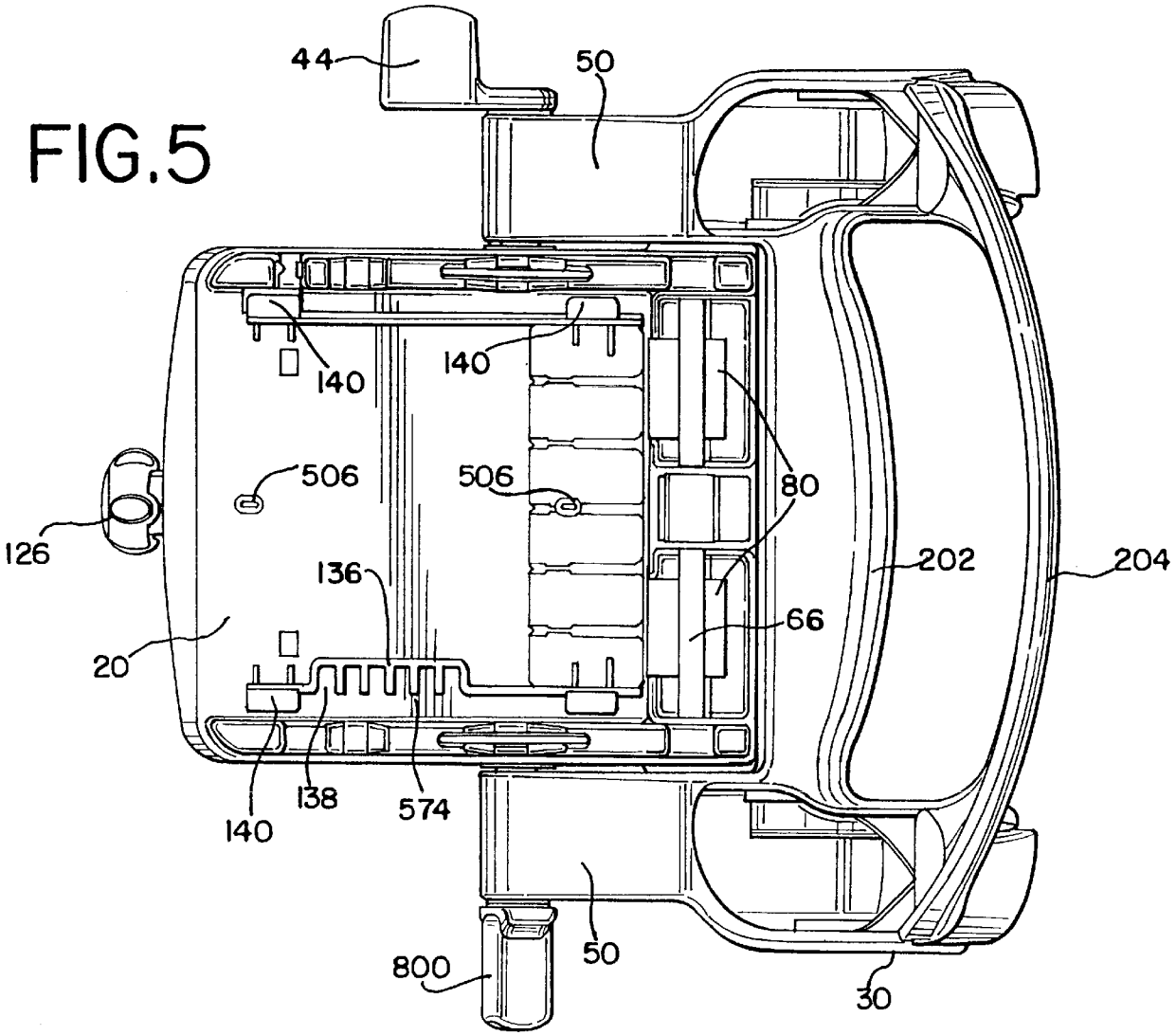
FIG. 5 is a partial top view of the chair taken along line 5—5 of FIG. 3 without armrest applied thereto.
Figure 13:
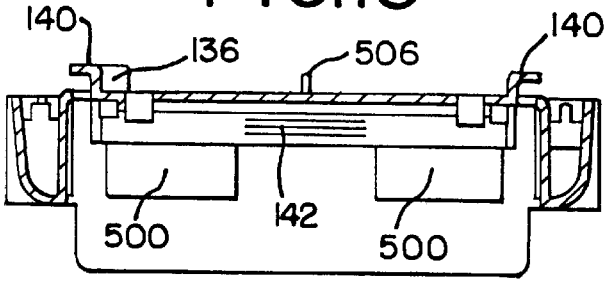
FIG. 13 is a cross-sectional view of the seat support taken along line 13—13 of FIG. 10.

The leaf springs 80 are constrained laterally within the housing by the sides of the slotted opening at the front of the housing and by the sides of a pair of openings 500, or notches, formed in a rear vertical wall of the seat support as shown in FIGS. 13 and 19. The leaf spring 80 extends rearwardly within the housing 10 such that a bottom surface 87 engages the pad members 94 of the fulcrum member 90. An end 84 of the spring is inserted beneath pivot rod 66 as shown in FIGS. 5 and 19 such that top surface 86 engages pivot rod 66. Although each spring is shown as a single leaf, it should also be understood that multi-leaf springs could also be employed. The leaf springs are preferably made of a composite material, such as a fiberglass and epoxy matrix, although it should be understood that other resilient materials such as steel would also work. The composite material can be a fibrous composite, a laminated composite or a particulate composite. A suitable composite spring is commercially available from Gordon Plastics, Inc. of Montrose, Colo. under the specification designation of GP68-UD Unidirectional Fiber Reinforced Bar Stock, and sold under the tradename POWER-TUFF. The fiberglass/epoxy matrix bar preferably is unidirectional with a glass content of about 68% and a laminate density of 0.068 lbs./in.$^3$. The bar preferably has a flexstrength of about 135,000 psi, a flex modulus of about 5,000,000 psi, and an ultimate strain of about 2.4%. The use of a composite material bar can help eliminate the problems associated with creep.

In operation, the end 84 of the leaf spring biases pivot rod 66, and the pivotally connected back support 30 and seat support 20, in an upward direction so as to thereby support a user sitting in the chair. Since the leaf spring 80 acts on the pivot rod 66, rather than on just one of the back support 30 or seat support 20, the supports 20, 30 are not required to transmit the biasing force to the other of the supports 20, 30, and can therefore be made less robust and at less cost. Rather, the bending loads are carried by the pivot rod 66. Obviously it should be understood, however, that the leaf spring could directly engage either the back support or seat support so that the upwardly biasing force is transmitted to the other thereof through the pivotal attachment. The opposite end 82 of the spring engages the cross member 130 or rod 88 mounted in the housing, while the middle of the spring is supported by the fulcrum member 90. In this way, the spring 80 acts as a simply supported beam with a load imparted intermediate the supported ends 82, 84 thereof To adjust the force applied to the pivot rod, the user simply rotates the knob 126 which causes the adjustment member 120, or shaft, to rotate and thereby threadably engage the fulcrum member so as to move it in a linear, longitudinal direction within the housing.

As the fulcrum member 90 is moved rearwardly in the housing 10, the distance between the point of support and the pivot rod is decreased as shown in FIG. 29, so as to correspondingly increase the force applied by the end 84 of the spring. Conversely, as shown in FIG. 28, the fulcrum member 90 can be moved forwardly in the housing 10 to decrease the amount of resistive force applied to the seat support and back support by increasing the beam length, or the distance between the fulcrum 90 and the pivot rod 66. Since the leaf spring 80 is simply supported at each end, rather being clamped to the housing, the pivot rod or both, bending moments are not introduced at the ends of the spring When clamped, the properties of the spring, and the amount of the clamping, can effect the loading and associated stresses. Moreover, by providing a simply supported spring, tolerances can be relaxed and the curvature of the spring is allowed to undulate as the beam length changes.

Because the leaf springs 80 are disposed in the housing 10 in a side-by-side arrangement, and are preferably formed as flat bars, the housing can be made more compact at lower cost in an aesthetically pleasing way. This advantage is even more apparent when the leaf spring arrangement is combined with the three bar mechanism. Moreover, the resistive force of the spring can be adjusted easily and simply by slideably moving the fulcrum 90 within the housing 10. Since the resistive force is determined by the beam length, rather than by prestressing the spring, the adjustment does not require a progressively larger actuation force as is typically associated with torsion springs and bars and compression springs.

Figure 14:
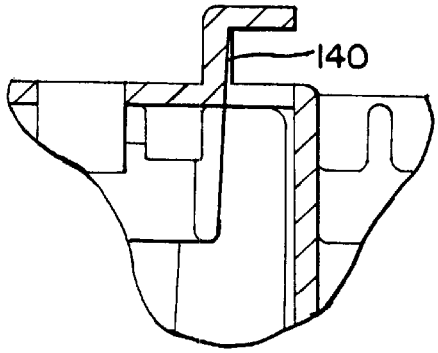
FIG. 14 is a partial enlarged cross-sectional view of a portion of the seat support shown in FIG. 13.

Now turning to FIGS. 11–14, a rack 136 is shown as being formed on a top of the seat support. The rack 136 consists of a plurality of outwardly facing notches 138 formed along one side of the seat support. The seat support also includes outwardly facing channels 140 that run longitudinally along the top surface of the seat support as shown in FIGS. 13 and 14.

A rack 142 is also formed on a bottom surface of the seat support. The rack 142 is formed along a concave portion of the bottom surface of the seat support and includes a plurality of laterally extending grooves 144.

Figure 8:
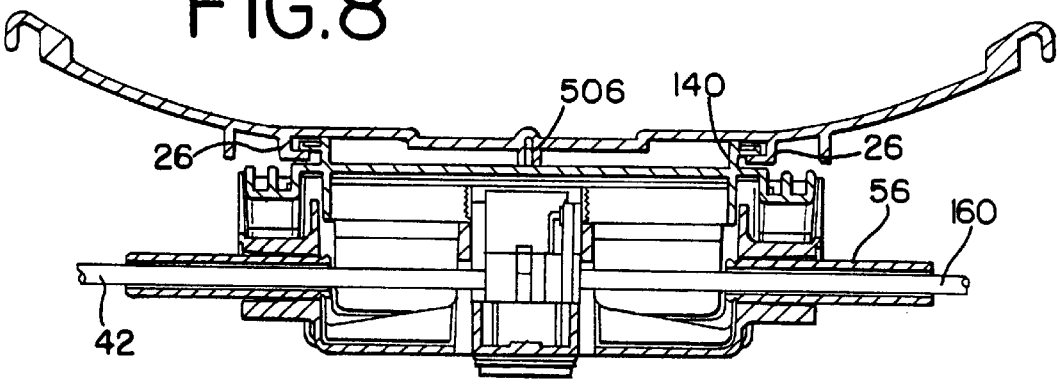
FIG. 8 is a cross-sectional view taken along line 8—8 of FIG. 4 without the back support shown.
Figure 10:
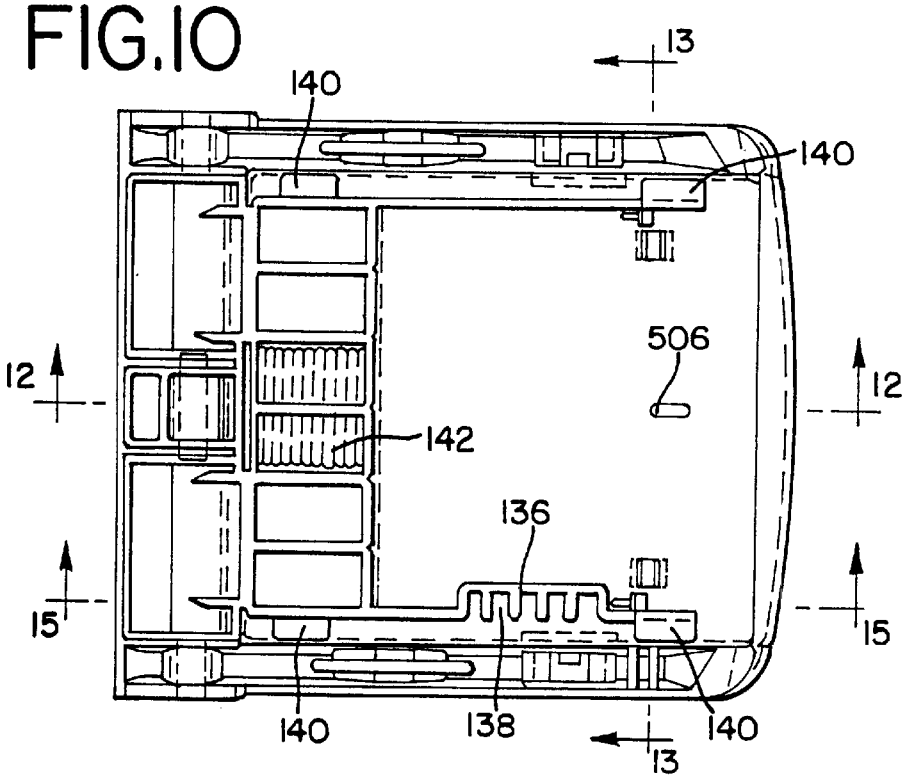
FIG. 10 is a top view of the seat support.
Figure 11:
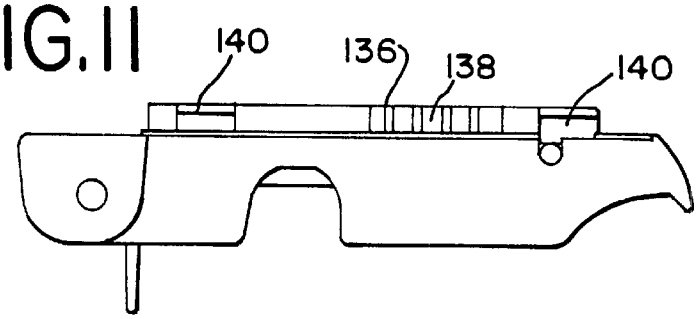
FIG. 11 is a side view of the seat support.
Figure 23:
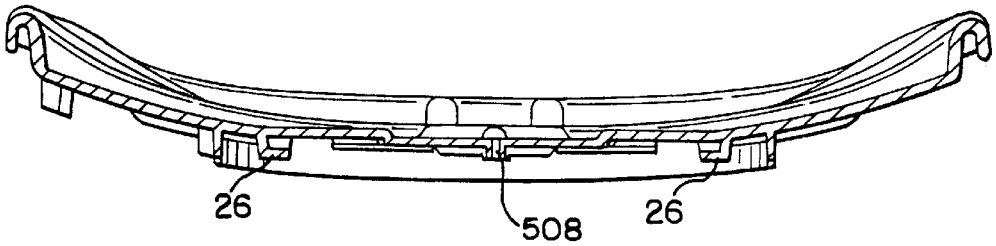
FIG. 23 is a cross-sectional view of the seat pan taken along line 23—23 of FIG. 22.

As shown in FIGS. 8 and 23, inwardly facing longitudinal channels 26 extend downwardly from the seat pan 24 and are aligned to communicate with and engage the outwardly facing channels 140 on the seat support. The seat pan 24 is slideably mounted to the seat support by slideably engaging the cooperating channels. In addition, a pair of longitudinally aligned pins 506, or similar protuberances, extend upwardly from the housing and are received in a pair of slots 508, or channels, formed in the seat pan. The pins prevent the seat pan from moving laterally with respect to the housing such that the lateral tolerances between the intermitting channels 26, 140 can be maintained rather loosely. Preferably, a seat cushion 22 is attached to the seat pan 24. The travel of the seat pan along a longitudinal path from front to back can be limited either by the travel of the pin within the slots, or by engagement of various stop members extending from one or both of the seat support and seat pan.

Figure 31A:
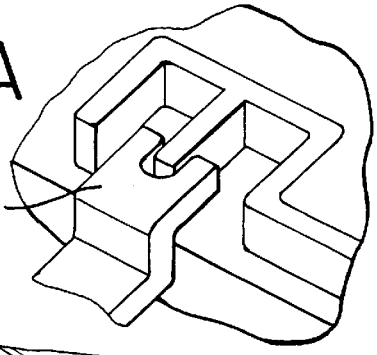
FIG. 31A is perspective view of an alternative adjustment mechanism for the seat pan.
Figure 31:
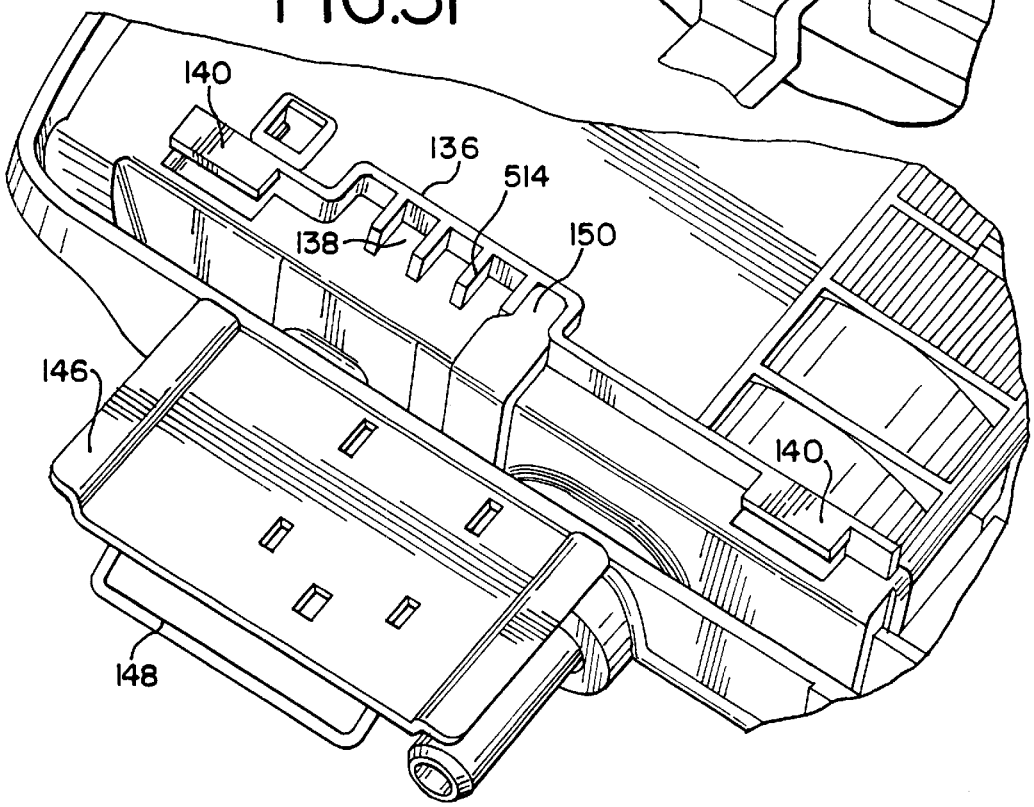
FIG. 31 is a partial top perspective view of the adjustment mechanism for the seat pan.

As shown in FIGS. 30 and 31, a bracket member 146 is mounted to a bottom of the seat pan with a plurality of fasteners engaging holes in the seat pan. A lever 148 having a handle and an inwardly extending nose portion 150 is slideably mounted to the bracket member. The nose portion 150 is shaped to releasably engage the notches 138 of rack 136. In operation, the user pulls the lever 148 outwardly to disengage the nose portion 150 from the rack 136 and thereafter slides the seat cushion and seat pan 24 forwardly or rearwardly with respect to the seat support 20 until a desired seat depth position is reached. The lever 148 is then pushed inwardly so that the nose portion 150 engages one of the notches in the rack 136. The lever 148 can also be spring mounted so as to be biased toward the rack and into the engaged position The seat cushion is attached to the seat pan.

Alternatively, as shown in FIGS. 9 and 31A, the nose portion 510 includes a notch 512 that is shaped to engage one of the ribs 514 forming the rack.

As shown in FIGS. 58–62, an information card 910 providing indicia for using the various chair mechanisms can be slidably mounted to the bracket 146. Preferably, the card and bracket are provided with travel limiting members to prevent the card from being removed from the chair where it can be then be lost.

Figure 16:
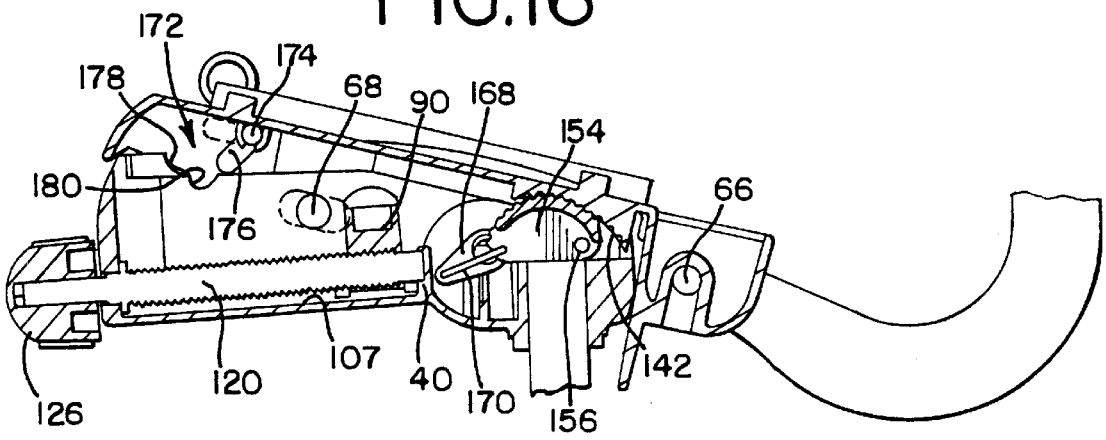
FIG. 16 is a cross-sectional view of the seat support and housing with the tilt limiter in a reclined tilt position.
Figure 17:
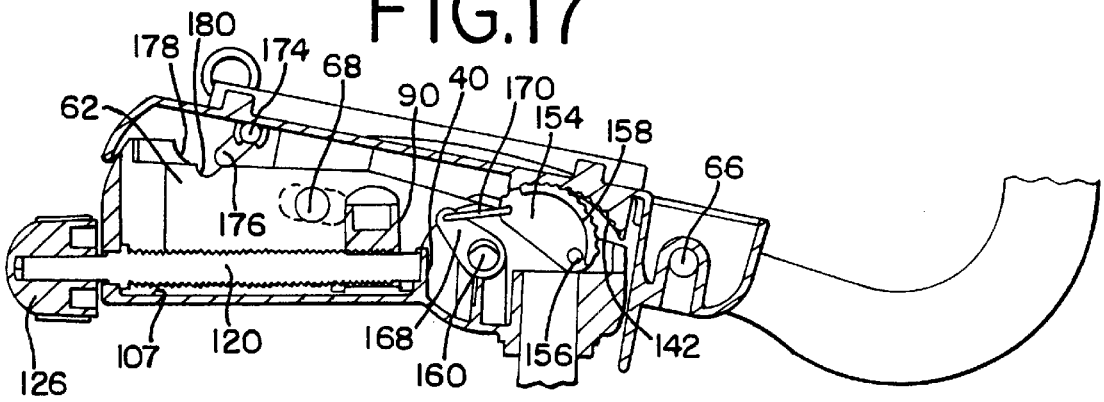
FIG. 17 is a cross-sectional view of the seat support and housing with a tilt limiter in an intermediate tilt position.
Figure 18:
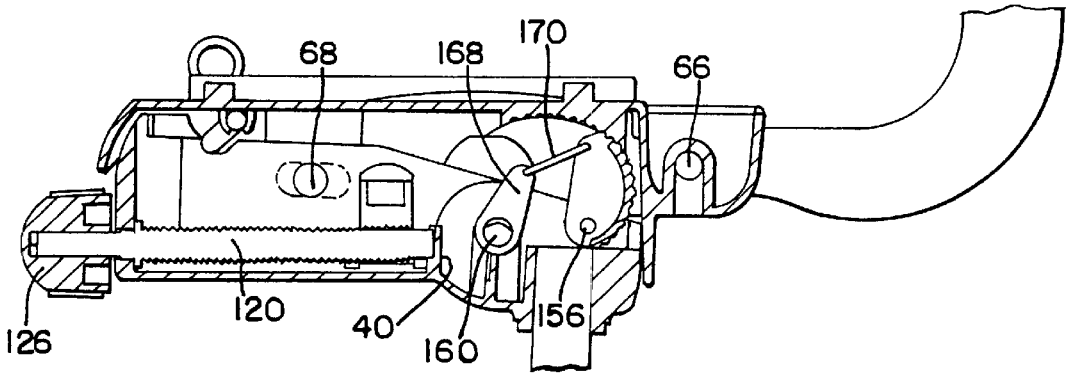
FIG. 18 is a cross-sectional view of the seat support and housing with a tilt limiter in a upright tilt position and the forward bias device in the normal seating position.

Referring to FIGS. 16–18, a tilt limiter 152 is shown as pivotally mounted to the housing on an axle 156. In one embodiment, the tilt limiter includes a cam member 154 having a substantially semi-circular shape with a convex upper surface shaped to communicate with and to engage the concave rack 142 of the seat support. The cam member is preferably one piece and is made from a single piece of high impact plastic, although it should be understood that other materials such as steel and other combinations of parts would also work. In the one piece embodiment, the axle is in-molded with the cam member. A bracket 182 is mounted over the axle to capture it between the bracket and the housing. A plurality of fine, laterally oriented teeth 158 are formed along the outer convex surface of the cam member. Teeth 158 engage the rack 142 formed on the bottom of the seat support to limit the rearward tilting of the seat support, and chair.

Figure 12:
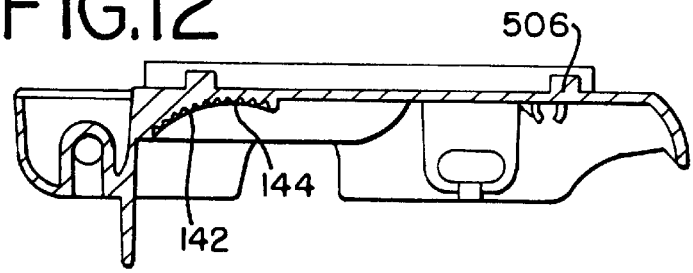
FIG. 12 is a cross-sectional view of the seat support taken along line 12—12 of FIG. 10.
Figure 12A:
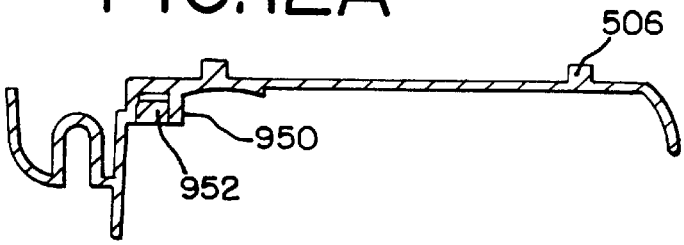
FIG. 12A is an alternative embodiment of the seat support shown in FIG. 12.
Figure 57:
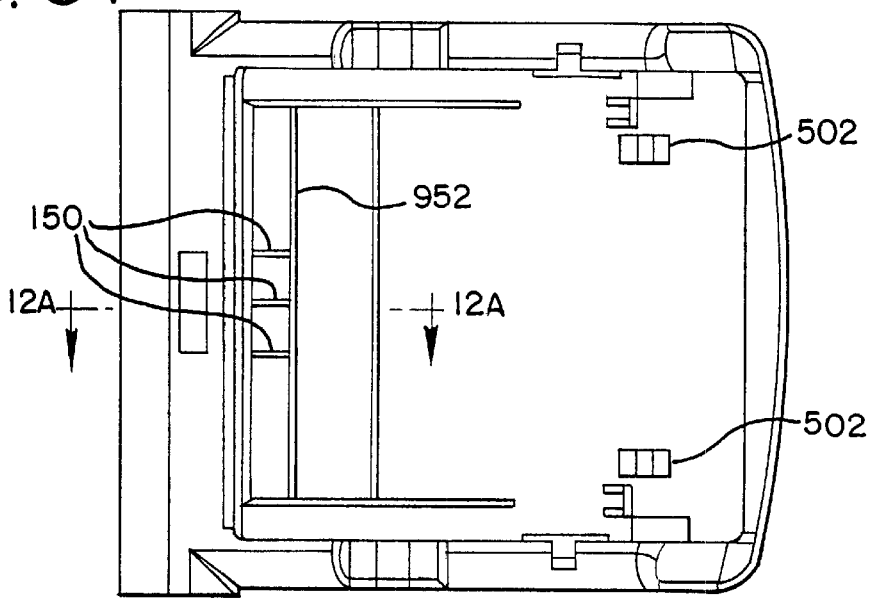
FIG. 57 is a bottom view of an alternative embodiment of the seat support.

In an alternative embodiment, shown in FIGS. 19–21, a plurality of larger stepped teeth 159, or engagement surfaces, are arranged around the periphery of the cam member 155. As shown in FIGS. 12A and 57, the seat support includes a plurality of longitudinally extending ribs 950 and a laterally extending rib 952 intersecting ribs 950. The cam member 155 can be rotated such that one of the plurality of teeth 159 engages the ribs 950, 952 to limit the rearward tilting of the seat support and chair.

Referring to FIGS. 16–21, a pivot rod 160 extends through and is rotatably mounted within the hollow pivot rod 56 connecting the back support 30 and the seat support 20 opposite pivot rod 42. A handle 800 is secured to one end of the pivot rod 160 and can be used to pivot the rod about a substantially horizontal axis. An opposite end of the pivot rod 160 is mounted to a pivot member 162 and is rotatably supported by lug member 164. A forwardly extending arm 168 of the pivot member 162 is pivotally connected to a connecting member 170, preferably formed from a piece of wire, which extends rearwardly to engage the cam member 154, 155. In operation, the handle 800 and pivot rod 160 are rotated to pivot the pivot member 162 and attached connecting member 170, which in turn rotates the cam member about axle 156 to the desired tilt position. As the user tilts rearwardly, the seat support 20 pivots and slides about the third pivot axis 68 until the rack 142 is brought into engagement with the teeth 158 on the cam member 154, or until the ribs 950, 952 engage the teeth 159 of cam member 155, wherein the seat support is prevented from tilting further rearwardly. Since, as shown in FIGS. 16 and 21, the cam member 154, 155 is pivotally attached to the housing along an axis off-center from the center of the approximately shaped arc formed by the convex surface of the cam member, the user can pivot the cam member about the off-center axis such that different sets of teeth 158 engage the rack 142 at various positions, or such that a different stepped tooth 159 engages the ribs 950, 952, wherein the seat support is engaged at varying desired tilt positions. For example, as shown in FIGS. 58–62, the tilt limiter, including the cam member, can be moved to a plurality of settings or positions so as to limit the rearward tilting of the seat to a plurality of maximum rearward tilt positions, including, but not limited to, a forward tilt position, an upright tilt position, various intermediate tilt positions and a reclined tilt position.

As shown in FIGS. 58–62, the handle 800 (also shown in FIG. 21), functions as a selector member for selecting the position of the tilt limiter. In particular, the selector member is rotated so as to rotate pivot rod 160, which in turn pivots the pivot member 162 and the connected cam member 154, 155 so as to vary the tilt position thereof The selector member includes indicia 910 for indicating the setting or position of the tilt limiter. In particular, as shown in the preferred embodiment of FIGS. 58–62, the selector member includes an intergrally formed substantially elongated flat portion 910 that extends laterally outward from and radially across the face of the selector member. The flat portion 910 has upper and lower concave surfaces and is grippable by a user for rotating the handle, pivot member and connected cam member. As shown in FIGS. 58–62, the angular orientation of the indicia 910, or flat portion, provides the user with an indication of the setting or position of the tilt limiter.

Figure 58:
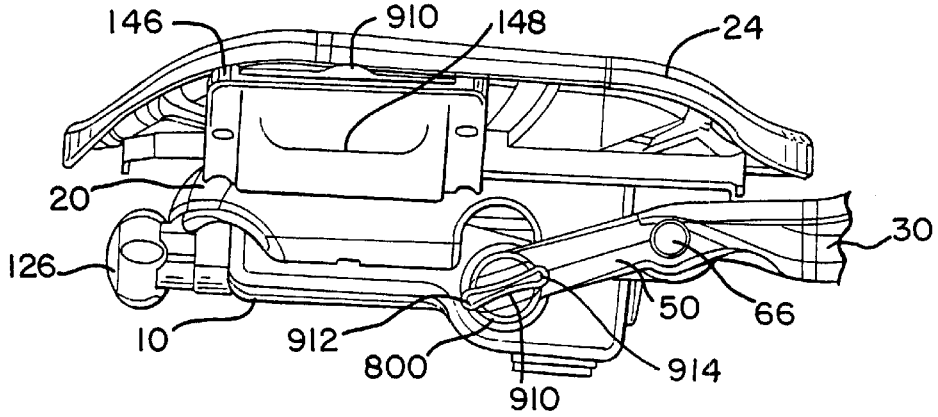
FIG. 58 is a partial side view of the chair with the seat shown at a maximum rearward tilt position comprising a forward tilt position and having a selector member and indicia positioned to indicate that the tilt limiter is in the forward tilt position.

For example, as shown in FIG. 58, a forward portion 912 of the indicia is angled downwardly, with a rear portion 914 angled upwardly, such that the angular orientation of the indicia substantially mirrors the relative position of the seat, the rearward tilting of which is being limited to a forward maximum rearward tilt position. As such, the selector member with its indicia provides the user with an indication that the tilt limiter is set at the forward tilt position such that the seat cannot be tilted rearwardly past the forward tilt position. As explained below, a forward bias device is actuated to permit the chair to be tilted into the forward bias position. The forward bias device, when used in combination with the tilt limiter positioned in the forward tilt position, allows the user to lock the seat and chair in the forward bias position such that it cannot be tilted rearwardly. It should be understood, however, that the forward bias device can be actuated without the tilt limiter being positioned in the forward tilt position.

Figure 59:
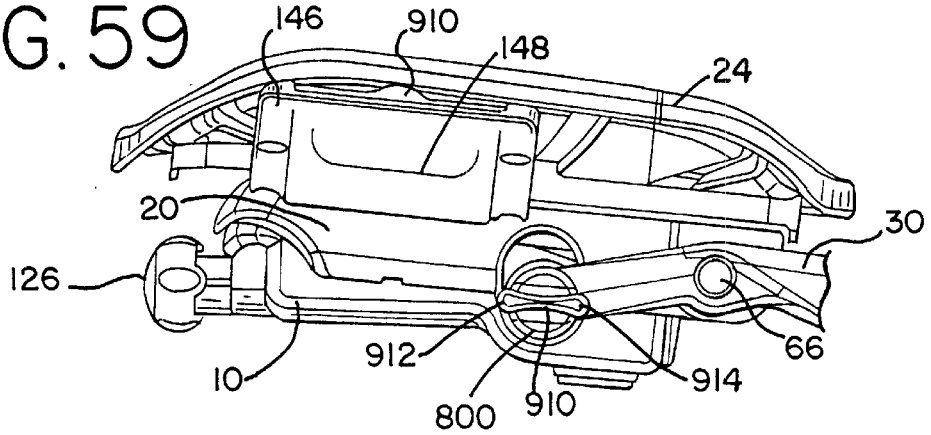
FIG. 59 is a partial side view of the chair with the seat shown at a maximum rearward tilt position comprising an upright tilt position and having a selector member and indicia positioned to indicate that the tilt limiter is in the upright tilt position.

Referring to FIG. 59, the indicia 910 is in a substantially horizontal position, which corresponds to the tilt limiter being in an upright or normal tilt position or setting. Again, the selector member with its indicia provides the user with an indication of the tilt limiter setting and informs the user that the seat cannot be tilted rearwardly past the upright tilt position. Although the seat is shown in the maximum rearward tilt position for this setting, which corresponds to the normal or upright tilt position, it should be understood that the user can tilt the seat forwardly, if permitted by a proper setting of the forward bias device, without affecting the position of the selector member or its indicia. Therefore, the user is apprised of the maximum available tilt position even when the seat is not located in that position.

Figure 60:
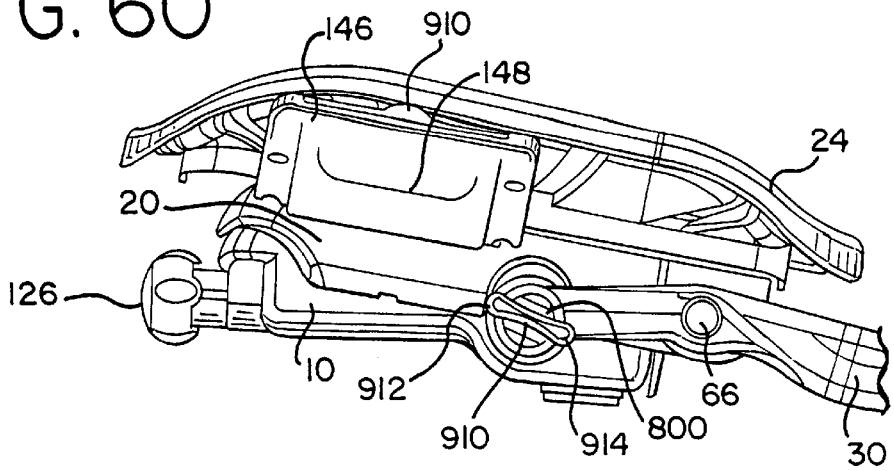
FIG. 60 is a partial side view of the chair with the seat shown at a maximum rearward tilt position comprising one of a plurality of intermediate tilt positions and having a selector member and indicia positioned to indicate that the tilt limiter is in one of the plurality of intermediate tilt positions.
Figure 61:
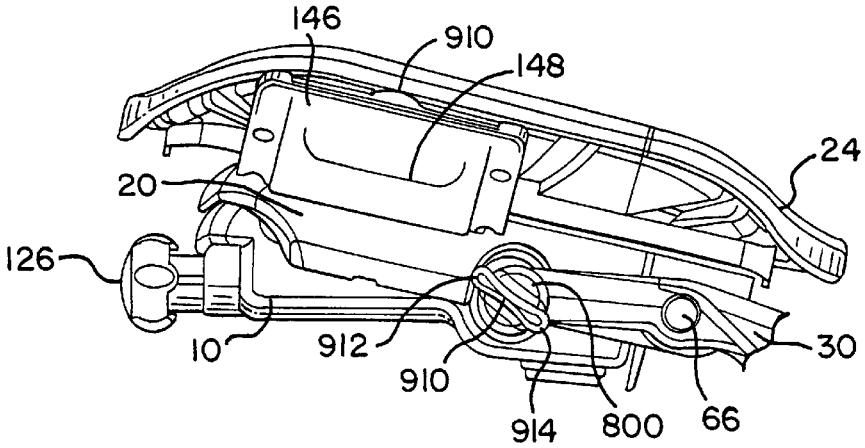
FIG. 61 is a partial side view of the chair with the seat shown at a maximum rearward tilt position comprising another of the plurality of intermediate tilt positions and having a selector member and indicia positioned to indicate that the tilt limiter is in another of the plurality of intermediate tilt positions.

Referring to FIGS. 60 and 61, the forward portion 912 of the indicia is now angled slightly upward with the rear portion 914 angled slightly downward so as to again mirror the maximum rearward tilt positions of the seat, which are shown as intermediate tilt positions. Again, the selector member with its ildicia provides the user with an indication of the tilt limiter setting and informs the user that the seat cannot be tilted rearwardly past one of the intermediate tilt positions. As explained above, the selector member with its indicia performs this notice function even when the seat is located at some tilt position other than the maximum rearward tilt position.

Figure 62:
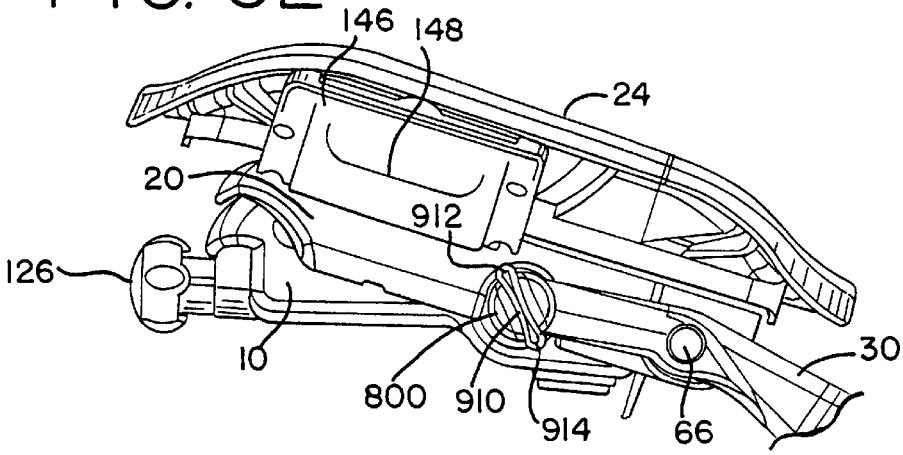
FIG. 62 is a partial side view of the chair with the seat shown at a maximum rearward tilt position comprising a reclined tilt position and having a selector member and indicia positioned to indicate that the tilt limiter is in the reclined tilt position.

Referring to FIG. 62, the indicia 910 provides the user with an indication of the tilt limiter setting and informs the user that the seat can be tilted rearwardly to its maximum reclined position.

The selector member with its indicia 910 provides a simple but ideal way to select the tilt position of the tilt limiter, and the corresponding maximum rearward tilt position of the seat, while simultaneously providing the user with an indication of the current maximum rearward tilt position of the seat. The user is informed of the maximum rearward tilt position of the seat even when the seat is in a tilt position other than the maximum rearward tilt position. For example, the selector member and tilt limiter can be set to the reclined position such that the indicia informs the user of that setting as shown in FIG. 62. The selector with the indicia will remain in this position even as the user tilts forwardly to any of a forward, upright or intermediate position so as to continue to inform the user that he or she can tilt rearwardly to the reclined position.

Although the selector member has been shown as a handle, or knob, with the indicia providing a grippable portion of the handle, it should be understood that that selector member can be configured as any number of members including for example, but not limited to, a lever, dial, arm or gear. In addition, it should be understood that the indicia can take many forms other than the integrally formed and laterally extending raised portion described above. For example, the indicia can be comprised of various numerical or alphanumeric characters, words or color codes applied to or formed on a selector member or similar member. Similarly, the selector member can be provided with any number of markings, including, but not limited to scales, grids and arrows, such that angular rotation thereof will provide the user with an indication of the corresponding position of the tilt limiter. The indicia, including any markings or etchings, can also comprise raised portions, indentations or applied materials, such as paint, or adhesive labels.

Although the preferred embodiment of the selector member with its grippable indicia has been shown as comprising the handle used to actuate the tilt limiter, it should be understood that the selector member can be separate from the handle, or similar actuator. In such an embodiment, the selector member is linked or connected to the tilt limiter or actuator so as to provide an indication of the tilt limiter setting.

As shown in FIGS. 16–19, a forward bias device 172 is rotatably mounted to the seat support 20 with a pair of C-shaped catches 502 and includes a rod 174 and a pair of cam members 176. The housing includes two pairs of notches 178, 180 shaped to receive the cam members along a top of each of the sidewalls 62 of the housing. In operation, as the user tilts rearwardly in the chair, as shown in FIGS. 16 and 17, the rod 174 is rotated such that the cam members 176 are pivoted forwardly so as to be substantially parallel with the seat support. As the user returns the seat to the upright position, the cam members are received in the upper notches 178, which define the forward bias position of the chair. Alternatively, the user can rotate the rod 174 such that the cam members 176 angle downwardly from the seat support and are received in the lower notches 180, which define the normal seating position of the chair.

Figure 6A:
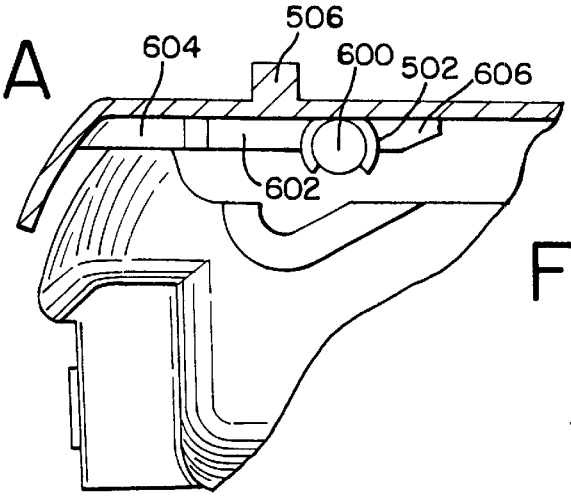
FIG. 6A is an alternative view of a section of the chair with a forward bias space applied thereto.
Figure 15:
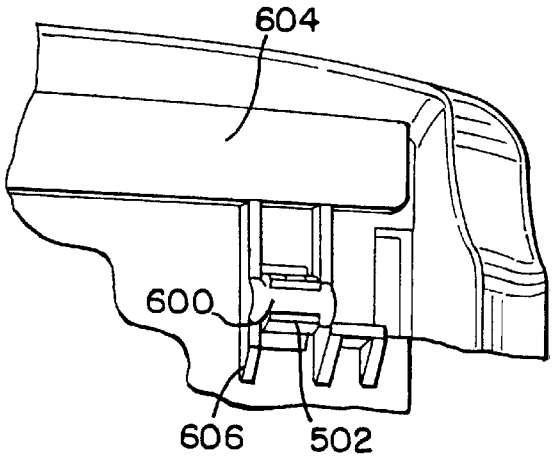
FIG. 15 is a partial view of the forward bias spacer mounted to the seat support.

Alternatively, a forward bias spacer can be mounted in the catches 502 as shown in FIGS. 6A and 15. The forward bias spacer includes an axle 600 connected to a laterally extending spacer member 604, or flange, with an arm 602. A rear portion of the arm extends rearwardly of the axle to act as a stop 606 such that the forward bias spacer cannot rotate about the axis of the axle. The spacer member 604 is positioned between the front wall of the housing and the bottom of the seat support and maintains the seat in the upright normal seating position. The forward bias spacer replaces the forward bias device when it is not desirable to have a chair that can be biased into the forward bias or tilt position.

Now referring to FIGS. 32–39, the back support 30 includes a pair of uprights 200 extending upwardly from the support arms 50. A lower cross member 202 connects the support arms and an upper cross member 204 connects the upper portions of the uprights. Preferably, the back support 30 is one piece and is formed from a single piece of material. As shown in FIGS. 1 and 3, the back support is exoskeletal in nature and provides the user with a strong visual of support, security and durability.

Figure 32:
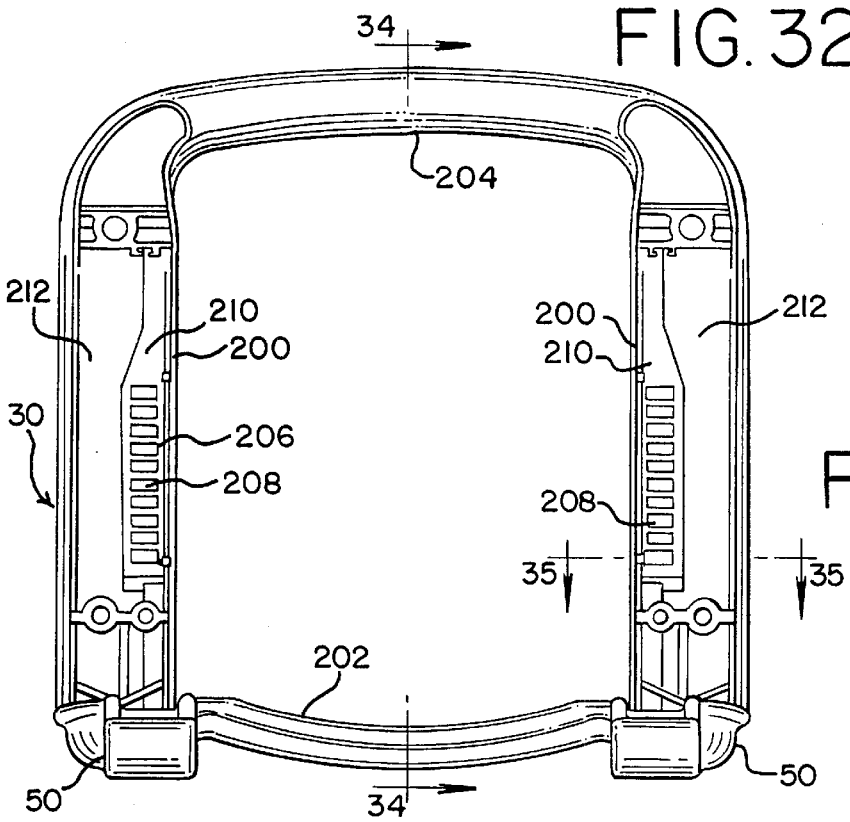
FIG. 32 is a front view of the back support.
Figure 35:
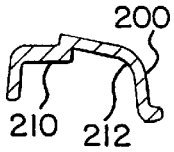
FIG. 35 is a cross-sectional view of the upright taken along line 35—35 FIG. 32.
Figure 34:
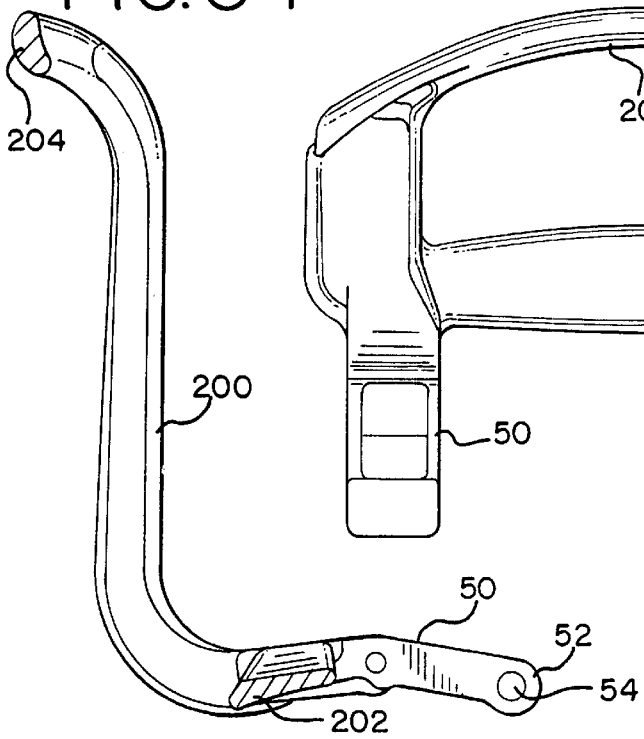
FIG. 34 is a cross-sectional view of the back support taken along line 34—34 of FIG. 32.
Figure 33:
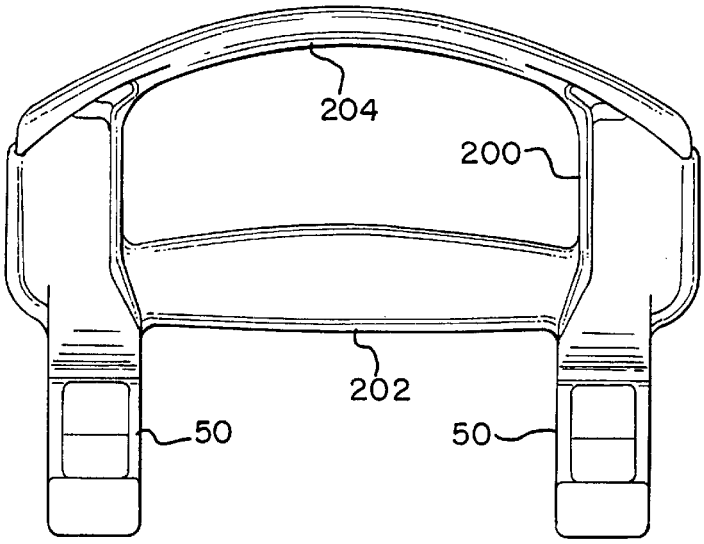
FIG. 33 is a top view of the back support.
Figure 36:
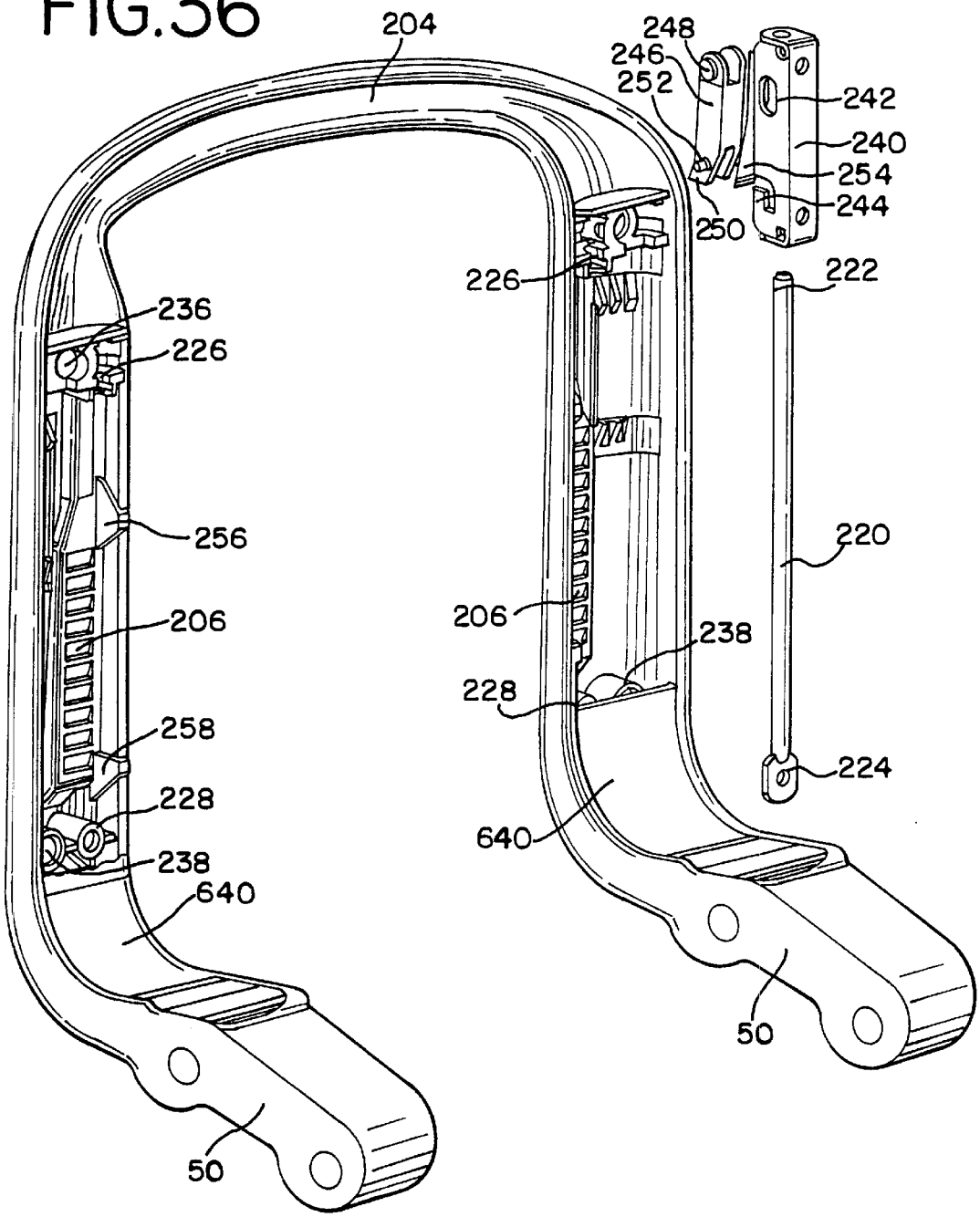
FIG. 36 is an exploded view of the back support, bar member, bracket, engagement member and spring.

Each upright 200 is preferably formed as a channel 212 as shown in FIGS. 32, 35 and 36. Cover members 640 are snap fitted onto lower portions of the back support to cover the lower portion of the channel. For example, in one embodiment, a rib extends from the channel and a corresponding rib extends from the cover so as to be aligned with the rib of the backsupport. The ribs are connected with S-shaped clips.

Figure 2:
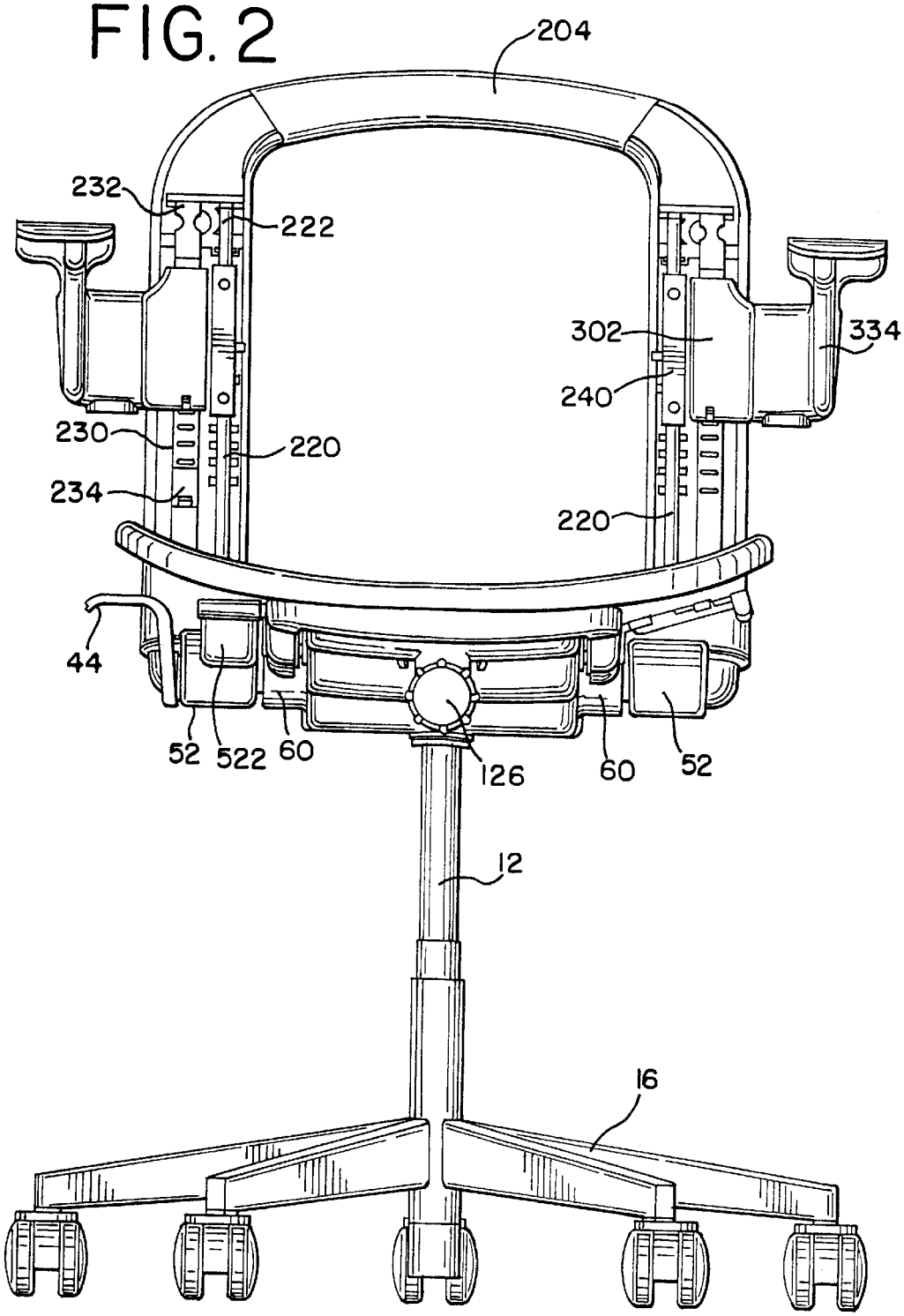
FIG. 2 is a front view of the chair without a backrest, seat cushion or armpads applied thereto.

A rack 206, consisting of a plurality of laterally oriented notches 208, is formed along an inner portion of the base portion 210 of the channel. As shown in FIGS. 1, 2 and 36, a bar member 220, preferably configured as a cylindrical rod, is installed in each channel 212 in an overlying relationship with the rack 206 by mounting opposite ends of the bar to the base portion 210 of the channel.

In a preferred embodiment, the upper end 222 of the bar member is received in a groove 226 while the lower end 224 is bolted to a lug 228 formed in the channel. Bar member 230, preferably having a flat rectangular cross-section, is mounted to the upright in a spaced apart and parallel relationship with bar member 220 by attaching opposite ends 232, 234 of the bar member to lug portions 236, 238 formed in the channel 212.

Figure 39:
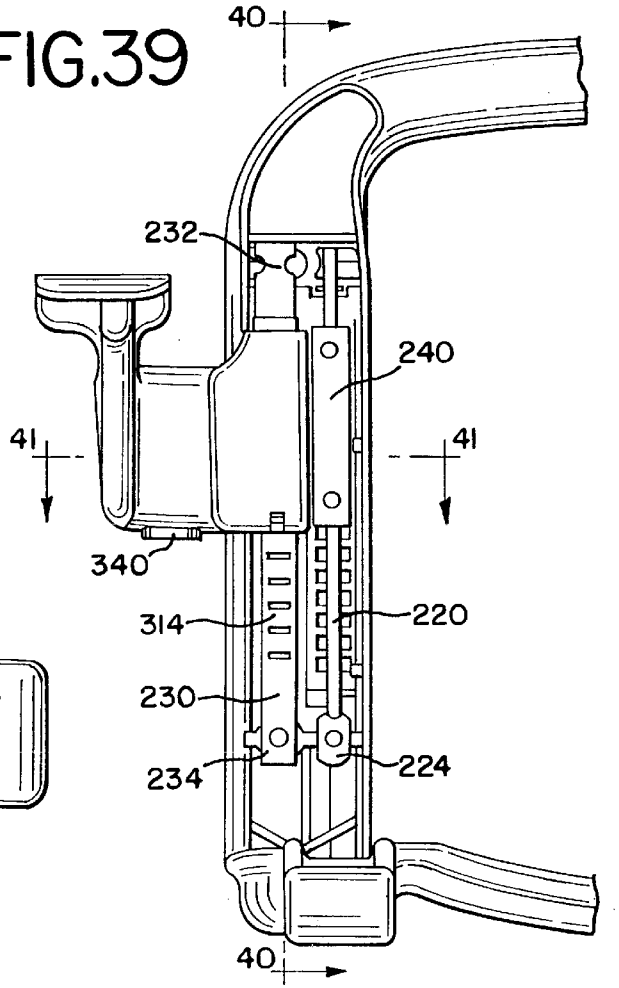
FIG. 39 is a partial front view of the back support with a first and second bar member and an armrest and backrest bracket applied thereto.
Figure 38:
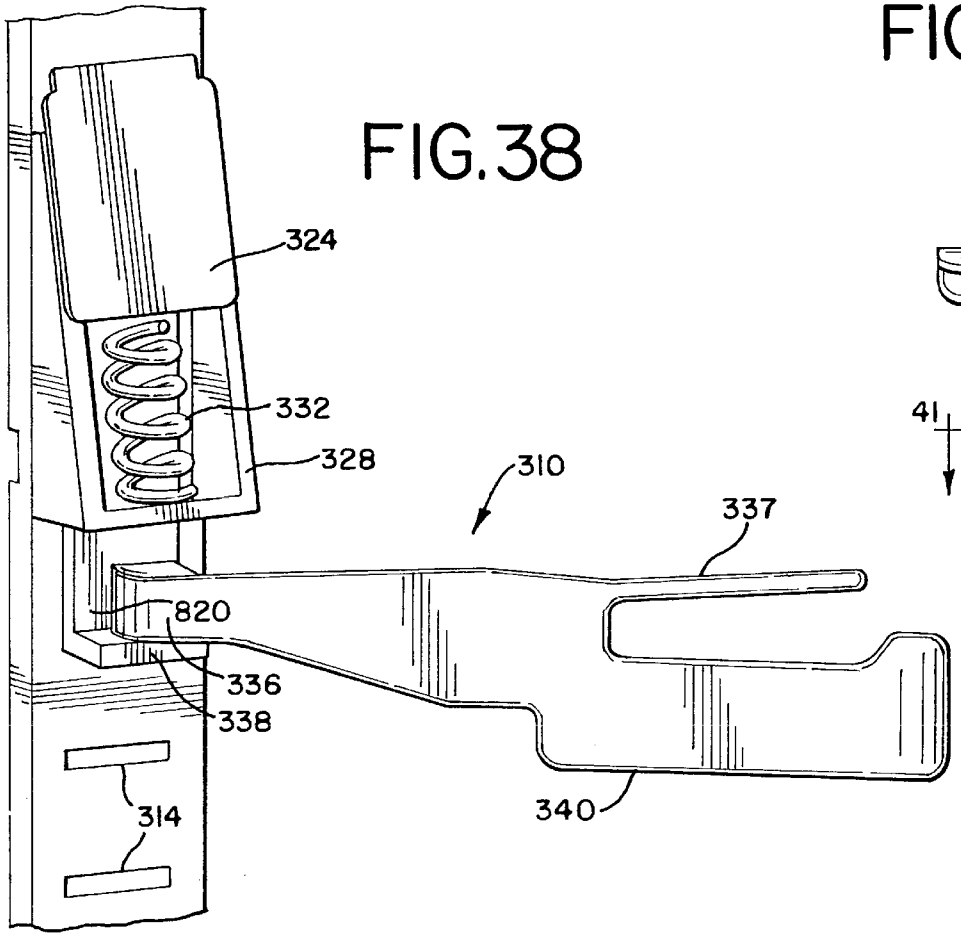
FIG. 38 is an enlarged perspective view of the locking device.

As shown in FIGS. 36 and 39, opposite ends of bracket 240 are slideably mounted on each bar member 220. As shown in FIG. 1, a backrest 32, preferably including a cushion and an internal pan (not shown) is attached to the brackets 240. The backrest 32, and brackets, slide along the bar members 220 and are releasably secured to the uprights of the back support with a locking device.

In a preferred embodiment, shown in FIG. 36, the bracket includes an upper vertically oriented slot 242 on each side of the bracket and a lower slot 244 extending inwardly from the edge of the bracket and then downwardly along a vertical path. A pawl member 246 is disposed within the bracket and is pivotally mounted within the upper slot 242 with a pair of guide members 248. A lower portion of the pawl member includes an engagement portion 250 adapted to engage the rack 206 and a pair of guide members 252 engaging the lower slot 244. A spring 254 is disposed within the bracket so as to bias the pawl 246 and engagement member 250 toward the rack 206. Preferably, either the pawl or the notches of the rack are tapered with a flat horizontal surface so as to allow the pawl to pass over the notches without engagement when traveling in the upward direction.

In operation, the backrest 32 is raised to a desired position where the engagement member 250 of the pawl 246 engages one of the notches in the rack. As the backrest is raised to its uppermost position, the guide members 252 engage a ramped guide rail 256 formed in the back support channel 212. The guide rail 256 forces the lower guide members 252 forwardly in the slot 244 against the force of the spring 254 and then downwardly in the slot 244 as the upper guide members 248 are also moved downwardly within the slot 242 so as to lock the pawl member in a disengaged position away from the rack. The user can lower the backrest to a lowermost position wherein a stop member 258 engages the guide members 252 to move the pawl 246 upwardly within the slots 244, 242 until the spring 254 biases the pawl forwardly into engagement with the rack, wherein the backrest can again be raised to the desired position. In this way a simple device is provided for adjusting the backrest without a multiplicity of moving parts and levers.

In an alternative embodiment, the pawl is simply pivotally connected to the bracket, without the additional slots that allow for vertical travel. The pawl is biased into engagement with the rack by the spring disposed between the bracket and the pawl. A paddle, similar to the one shown in FIG. 44, extends inwardly from the pawl so as to be exposed to the user adjacent the upright. The paddle can be actuated by the user in opposition to the spring so as to disengage the pawl wherein the backrest can be raised or lowered to the desired position.

Figure 44:
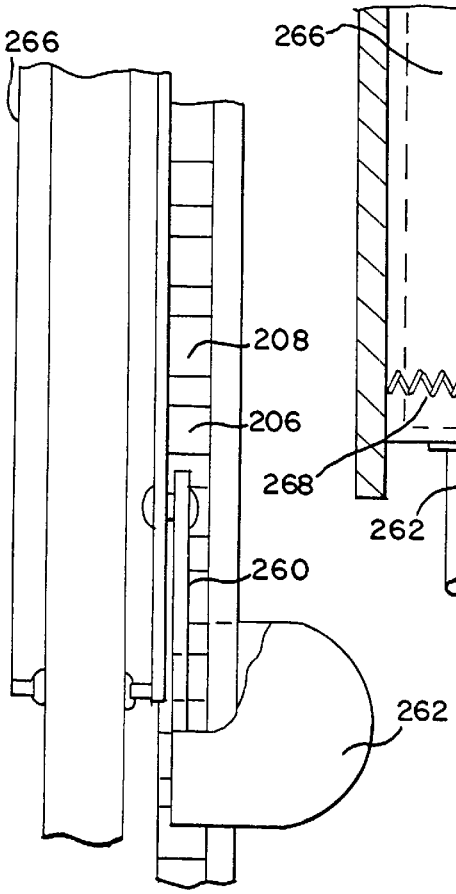
FIG. 44 is a front view of an alternative embodiment of a locking device for the backrest.
Figure 45:
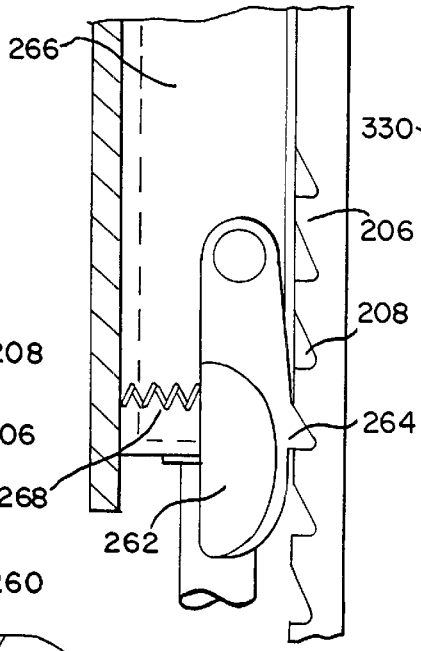
FIG. 45 is a side view of the locking device shown in FIG. 44.

A similar device is shown in FIGS. 44–45. Since this embodiment of the backrest support structure is similar to previously described embodiments, similar parts appearing in FIGS. 44 and 45 are represented by the same reference numbers. As shown in the alternative embodiment of FIGS. 44 and 45, a lever 260 including a handle 262, or paddle, and a nose portion 264 is pivotally attached to a bracket 266. The handle 262 extends laterally inward from the upright 200 and is exposed to the user adjacent the upright. The nose portion 264 engages one of the notches of the rack. A spring 268 biases the handle 262 and lever rearwardly to maintain operable engagement between the nose portion 264 and the rack. To adjust the height of the backrest 32, the user pivots the handles and lever forwardly to disengage the nose portion from the rack and thereafter slides the backrest to the desired position. In a preferred embodiment, the lever is biased against the neck with a spring. The lever is then released so that the nose portion engages the rack once again. Preferably, the nose portion and cooperating notches in the rack are tapered upwardly such that the backrest can be moved upwardly without moving the handle and lever. For upward adjustment, the user simply lifts the backrest such that the nose portion rides over the notches until the desired height is reached.

Figures 52, 53, 54, 55:
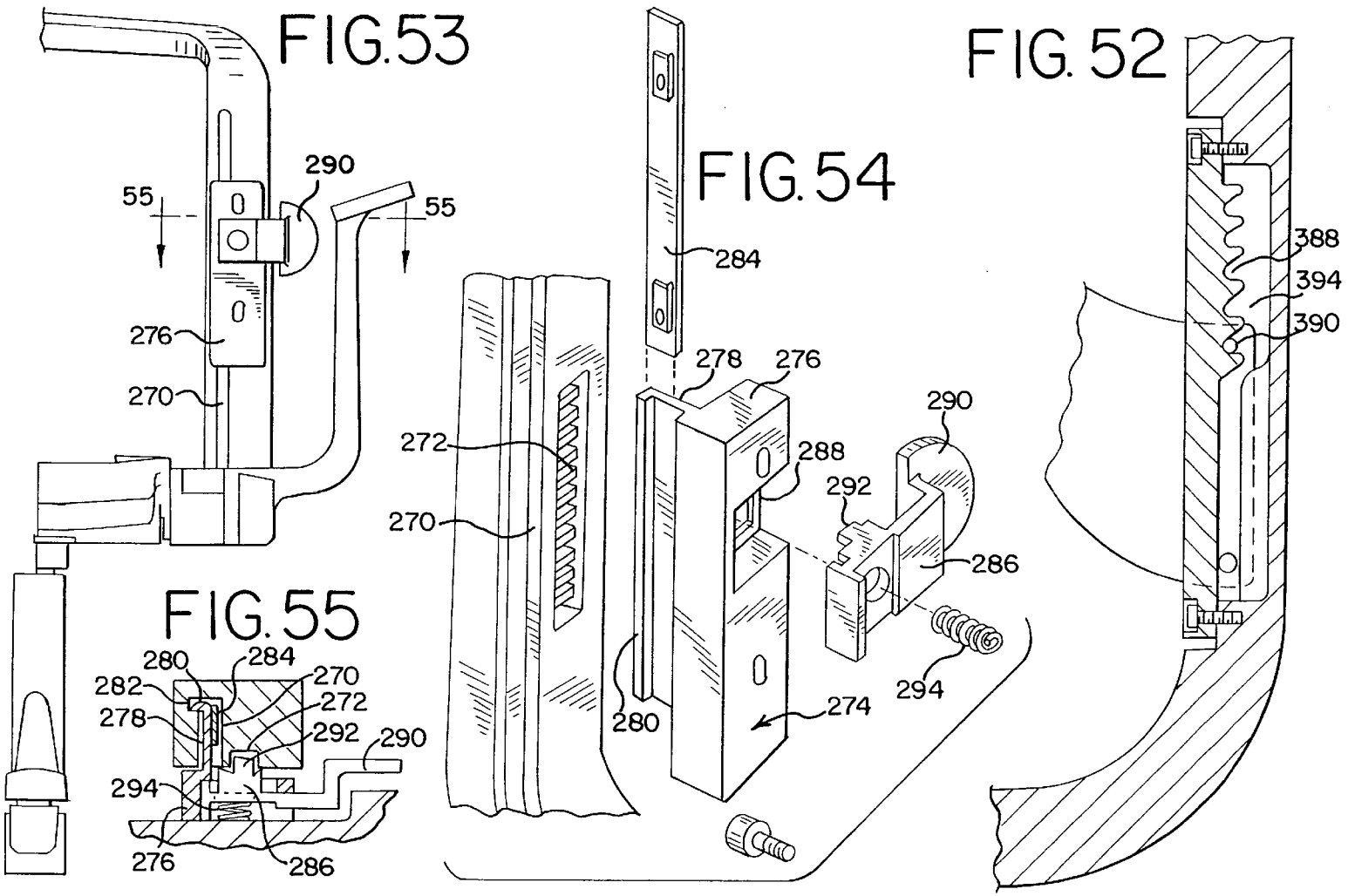
FIG. 52 is an alternative embodiment of the locking device for the armrest.
FIG. 53 is an alternative embodiment of the back support and armrest.
FIG. 54 is a partial exploded view of the backrest adjustment mechanism shown in FIG. 53.
FIG. 55 is a cross-sectional view of the back support and backrest taken along line 55—55 of FIG. 53.

In yet another alternative embodiment shown in FIGS. 53–55, the upright includes a longitudinal groove 270. A rack 272 is formed in the upright adjacent to and in parallel relationship with the groove. A spline member 274 has a base portion 276 and a tongue member 278 extending rearwardly from the base portion and terminating in a hook portion 280. The tongue member 278 is inserted in the groove 270 such that the hook portion 280 engages an inner track 282 opening into and communicating with the groove Once the tongue and hook member are engaged in the groove and track, a plate member 284 is inserted and snapped into place between the tongue 278 and a surface of the groove so as to securely mount the spline 274 to the upright in a sliding relationship. A latch member 286 is installed in a recess 288 formed in the base portion 276 and includes a inwardly extending lever 290 accessible to the user adjacent the upright. A nose portion 292 of the latch member engages the notches in the rack. A spring 294 is installed between the latch member and the backrest, which is mounted on the base portion, to bias the nose portion into engagement with the rack. The latch member 286 is retained in the recess of the base portion by the back portion and spring. In operation, the backrest can be adjusted as described above In this embodiment, the armrests are shown as being fixedly attached to the housing, but it should be understood that they can be made height adjustable as explained below.

Since the backrest is supported on opposite sides of the chair, it does not need to be structural in nature, and can be made at less expense and with more tolerance at the interface of the backrest and uprights. Moreover, the load imparted by a user against the side of the backrest can be transmitted directly through the forwardly extending arms of the back support to the housing and spring member so as to provide better support for the user. Additionally, the lever for releasably locking the backrest is preferably located adjacent the uprights at the side of the chair, and is therefore easily accessed by the user.

In addition, the backrest 32 covers the channel 212*b* in the upright so as to conceal the bar members 220, 230, the backrest bracket 240 and the armrest base portion 302 having the locking device disposed therein. In this way, the chair is provided with an exoskeleton backrest support, but with the sliding and locking parts concealed from the user so as to provide an aesthetically pleasing appearance.

Figures 37, 37A:
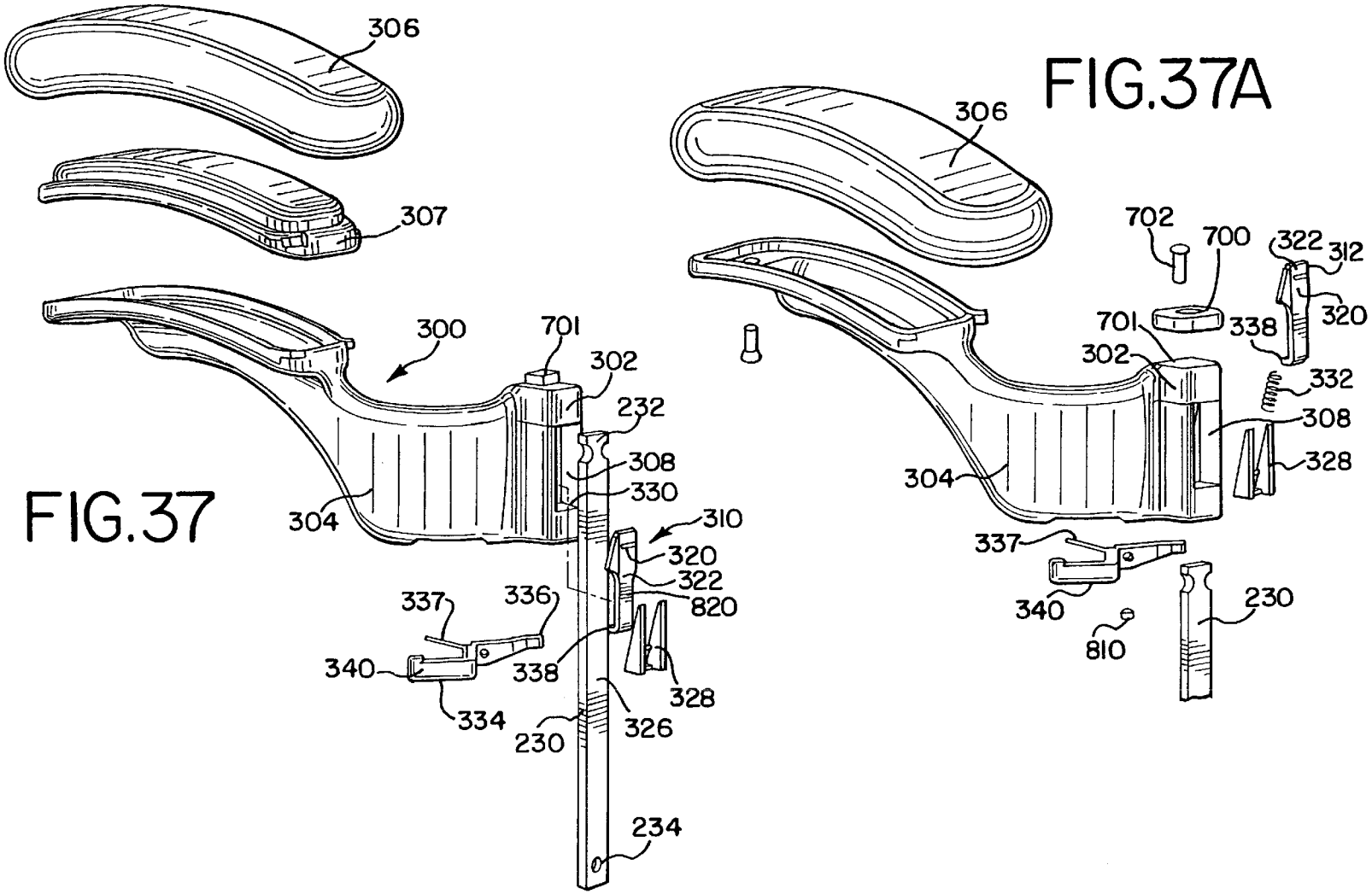
FIG. 37 is an exploded view of the armrest and locking device.
FIG. 37A is a partial view of an alternative embodiment of the armrest.

Another feature of the improved chair is the adjustable armrest 300 shown in FIG. 37, which is slideably mounted on bar member 230. Each armrest 300 includes a base portion 302 and an arm portion 304 extending forwardly from the base portion. Preferably, pads 306 are installed on an intermediate support 307 which are then mounted on an upper surface of the arm portion. A cavity 308 is formed internally in the base portion. An upper and lower opening communicate with the cavity and are shaped to receive bar member 230. A locking device 310, including a latch member 312, is disposed in the cavity and releasably engages a rack 314 consisting of a plurality of notches formed in a front surface 316 of the bar member. Preferably, as shown in FIG. 40A, the cavity 308 has front wall 318 which forms an oblique angle with the front surface 316 of the bar member which passes through the cavity. Likewise, the latch member 312 is configured as a wedge-shaped member having opposite surfaces 322, 324 forming an oblique angle with each other. The latch member also includes a protuberance 320, or tooth, extending rearwardly from the rear surface 322.

Figure 40:
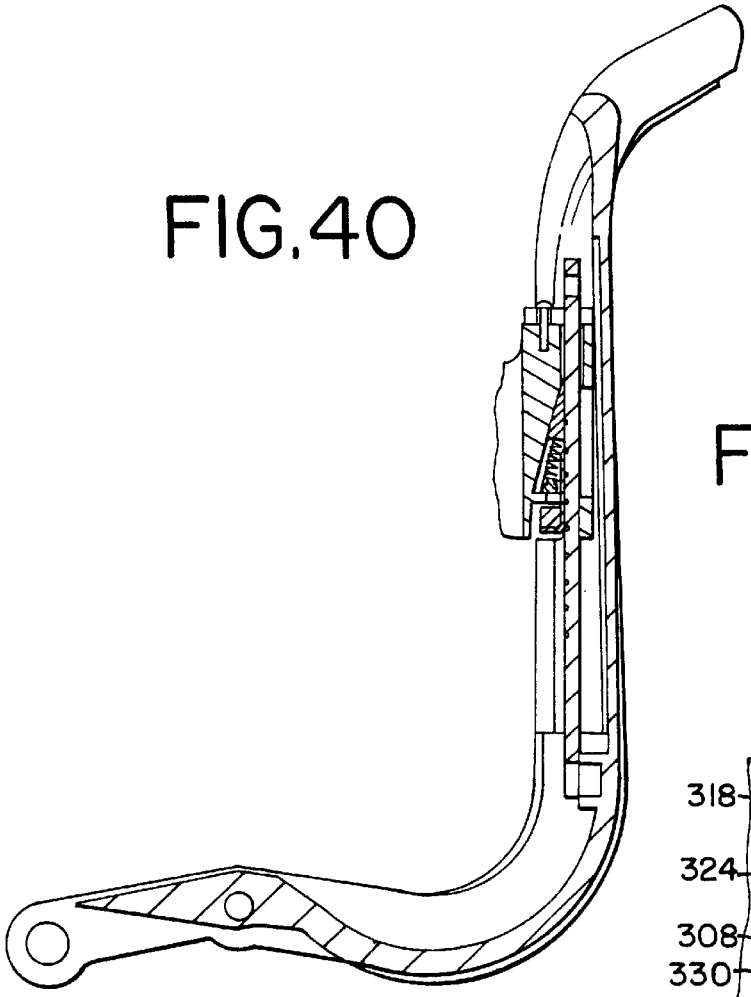
FIG. 40 is a cross-sectional view of the back support and armrest taken along line 40—40 of FIG. 39.
Figure 40A:
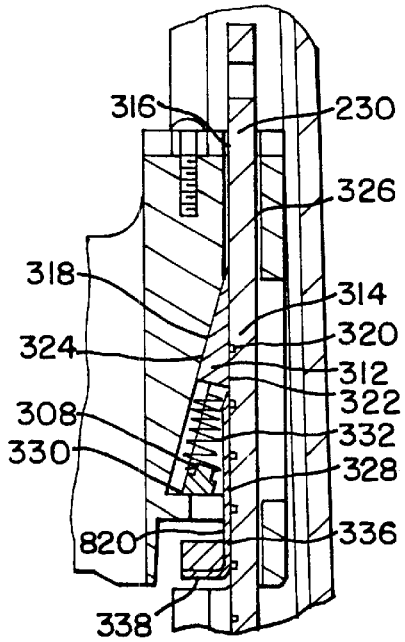
FIG. 40A is an enlarged view of the armrest locking device shown in FIG. 40.
Figure 41:
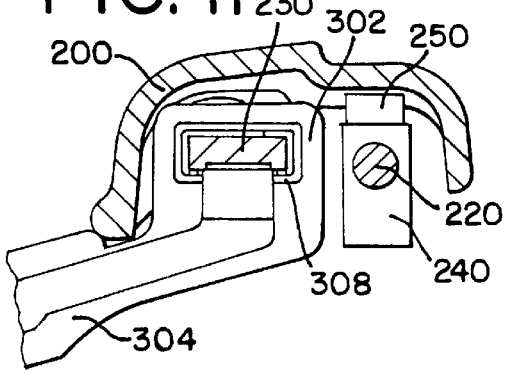
FIG. 41 is a cross-sectional view of the back support, backrest bracket and armrest taken along line 41—41 of FIG. 39.
Figure 42:
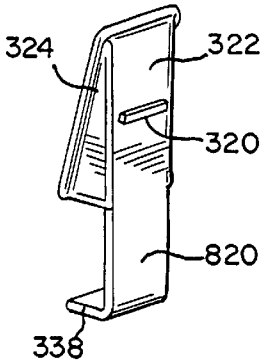
FIG. 42 is a perspective view of a latch member.

In an alternative embodiment shown in FIGS. 37A and 40, a cap 700, preferably metal, is mounted to the top of the base portion with a fastener 702. The base portion includes a raised boss 701 on which the cap is disposed. The cap has an opening 704 shaped to receive the bar member. The cap member is preferably formed with a slightly smaller opening than the upper opening in the base portion so that the metal cap member absorbs the loading from the arm. The boss 701 and the fastener 702 then transmit the load into the base portion of the armrest.

By providing uprights along opposite sides of the chair, the armrests can be conveniently attached to the uprights, rather than being supported by separate supports extending from the base or housing of the chair. In this way, the armrests can be firmly attached in a simple way at less cost.

In operation, the wedge-shaped latch member 312 is disposed in the cavity such that the rear surface 322 abuts the front surface 316 of the bar member and such that the protuberance 320 is received within one of the notches of the rack. The front oblique surface 324 abuts the front wall of the cavity 318. The latch member includes a downwardly extending trigger member 820 having an outwardly extending flange member 338. The wedge shaped latch member biases or wedges the base portion against the rear surface 326 of the bar member so as to tightly secure the armrest to the upright and thereby provide a firm support for the user's arm. A guide member 328 is mounted within the cavity in the base portion and engages a bottom surface 330 of the cavity A spring 332 is inserted between the guide member 328 and the wedge-shaped latch member 312 to bias the latch member upwardly against the armrest and against the bar member.

As shown in FIG. 37, a lever member 334 is pivotally mounted to the bottom of the armrest and includes an end 336 operably engaging an outwardly extending flange 338 of the latch member 312. Alternatively, as shown in FIG. 37A, a U-shaped clip 810 is disposed over the lever and engages the armrest to secure the lever in the armrest such that it pivots about a fulcrum in the armrest. The lever member preferably includes a cantilevered spring portion 337 that engages a surface in the arm to bias outwardly a button portion 340 of the lever that is exposed to the user.

To adjust the armrest, the user pushes end 340 of the lever member so as to pivot the opposite end 336 while simultaneously lifting the armrest. In this way, the end 336 of the lever acts on the flange 338 of the latch member to pull it down against the force of the spring 332. As the arm is moved relative to the latch member, the latch member slides along the front wall 318 of the base portion such that the protuberance, or tooth, disengages from the rack in the bar member. When the latch member is disengaged, the user can move the armrest to the desired position. The user can thereafter release the lever and armrest to reengage the bar member by engaging the rack with the protuberance or tooth. As with the backrest, the armrest can be moved upwardly without actuating the lever, since the upward movement naturally allows the latch member to disengage from the bar as it slides downwardly within the cavity.

Figure 43:
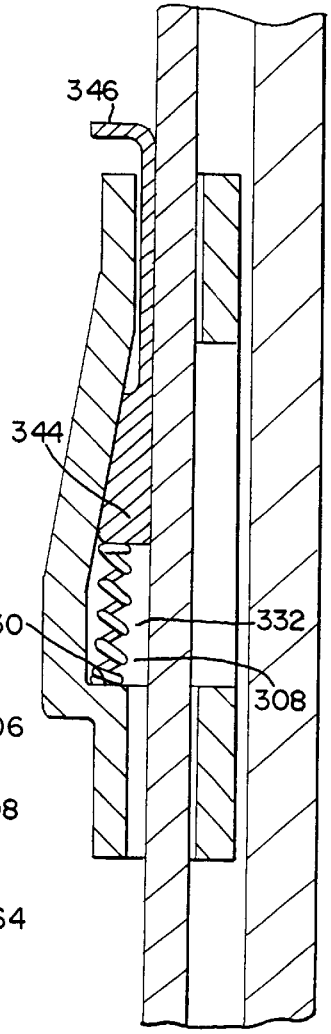
FIG. 43 is a partial perspective view of an alternative embodiment of the locking device for the armrest.

As shown in FIG. 43, an alternative embodiment of the locking device includes a wedge shaped latch member 344 disposed in the cavity, but without a protuberance or corresponding rack on the bar member, although it should be understood that such aspects could be incorporated into the device. Parts similar to those described above are represented by the same reference number for the sake of simplicity. A spring 332 is disposed in the cavity 308 between a bottom wall 330 of the cavity and a bottom surface 342 of the latch member. A lever 346 extends upwardly from the wedge shaped member through the upper opening in the base section so to be exposed to the user. In operation, the user pushes the lever downwardly against the force of the spring while lifting the armrest to thereby relieve the frictional forces acting between the armrest, latch member and bar member. The armrest can then be moved to the desired position where the lever is then released, the spring acting on the latch member to force it once again into frictional engagement between the armrest and bar member. In such an embodiment, the armrest is provided with infinite adjustment capability.

Figure 46:
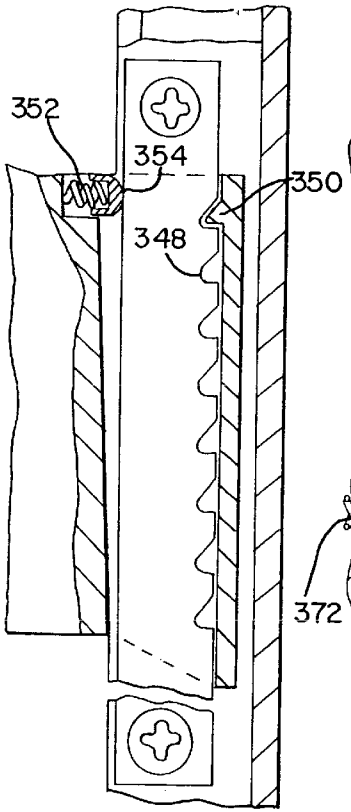
FIG. 46 is an alternative embodiment of the locking device for the armrest.

In yet another alternative embodiment shown in FIG. 46, a rack 348 is formed along a rear surface of the bar member and the base portion includes a integrally formed nose portion 350 shaped to be received within the rack. As with the backrest, the nose portion 350 and rack 348 are preferably tapered in an upward direction. A spring 352 and button 354 are installed in a top portion of the base and engage a front surface of the bar member. Alternatively, it should be understood that a leaf spring could be substituted for the spring and button. In operation, the user simply lifts up on the arm portion of the armrest in opposition to the force of the spring so as to disengage the nose portion. The armrest is then moved to the desired position and released such that the nose portion engages a notch in the rack.

Figure 49:
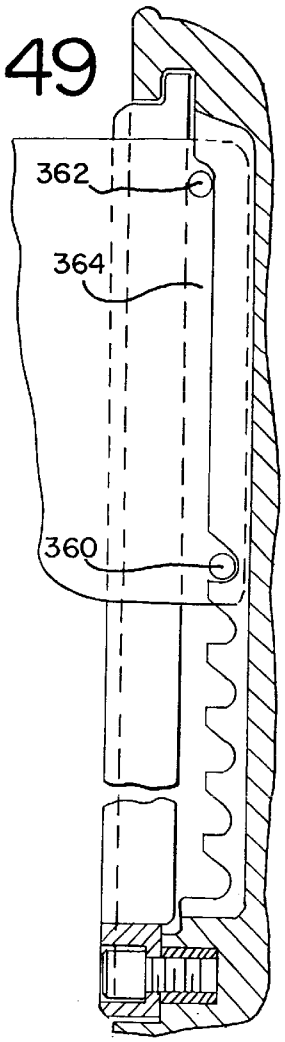
FIG. 49 is an alternative embodiment of the locking device for the armrest.
Figure 48:
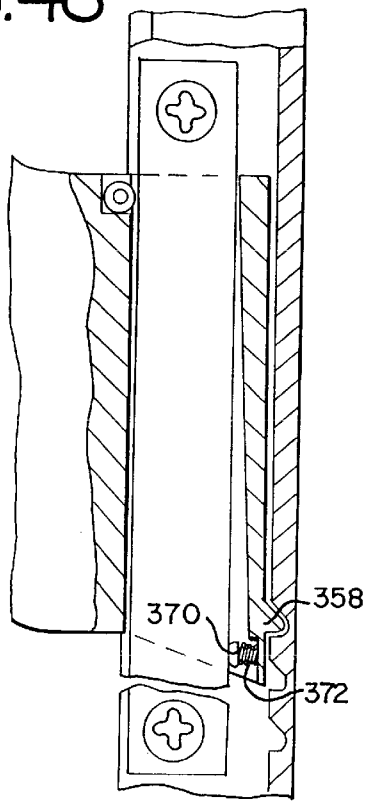
FIG. 48 is an alternative embodiment of the locking device for the armrest.
Figure 47:
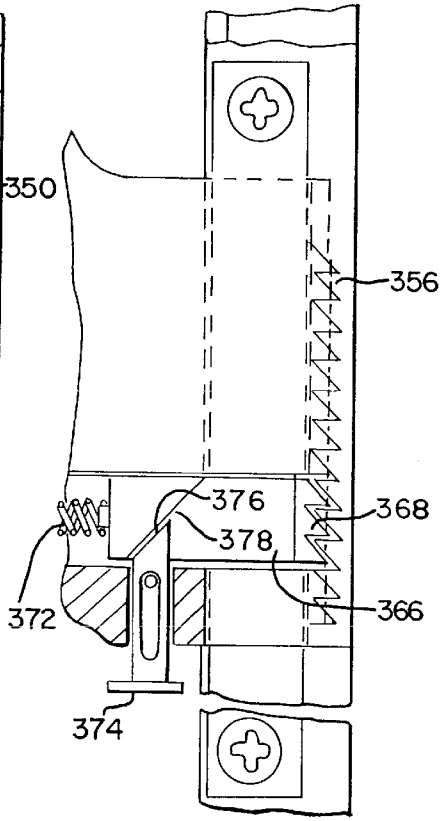
FIG. 47 is an alternative embodiment of the locking device for the armrest.
Figure 56:
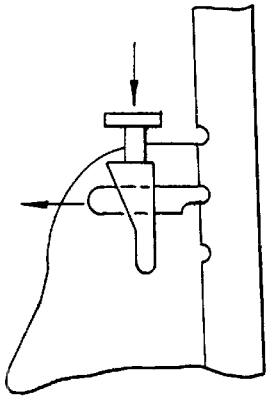
FIG. 56 is an alternative embodiment of the locking device for the armrest.

Referring now to FIGS. 47–49, various embodiments of a locking device are shown as having a rack 356 formed in the base portion of the upright, again with upwardly tapered notches. The armrest includes either a nose portion 358 integrally formed in the base portion, FIG. 48, a first pin 360 attached to the base portion and engaging the rack and a second pin 362 trapped in a track 364 formed between the bar and the upright channel, FIG. 49, or a latch member 366 having a nose portion 368, FIG. 47, which engages the rack. The device of FIG. 48 also includes a button 370 and spring 372 to bias the armrest into engagement. Again, it should be understood that a leaf spring could also work in place of the button and spring. The device of FIG. 47 includes a button 374 having a wedge shaped surface 376 that engages a cooperating wedge shaped surface 378 on the latch member 366. The button is actuated to force the latch member forwardly against the force of a spring as the wedge shaped surfaces slide over each other and thereby disengages the nose portion from the rack. A similar device is shown in FIG. 56, but with the rack located on the bar member.

Figure 50:
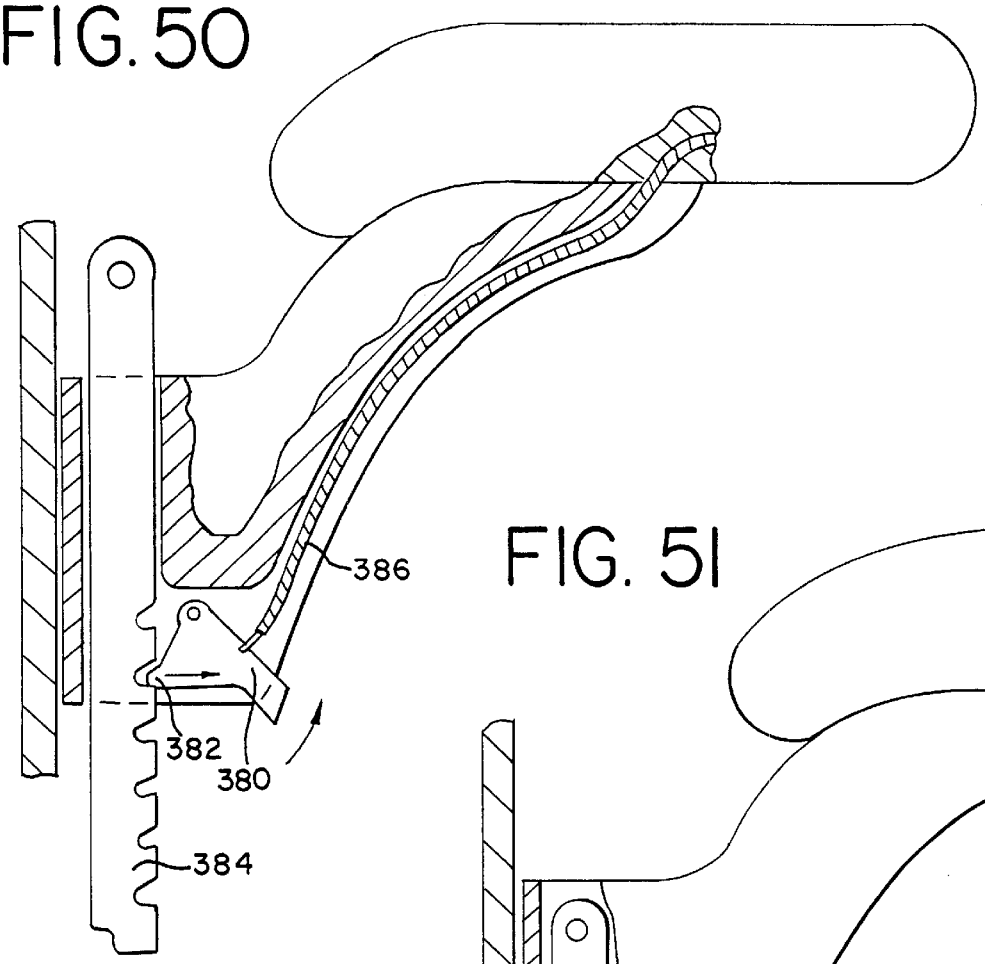
FIG. 50 is an alternative embodiment of the locking device for the armrest.

In yet another alternative embodiment shown in FIG. 50, a pivot member 380 is pivotally mounted to the base portion of the armrest. The pivot member includes a nose portion 382 shaped to engage a rack 384 located on the bar member. A cable 386 is connected to the pivot member. In operation, the user actuates the cable to pivot the pivot member into and out of engagement with the rack. Alternatively, the pivot member can be directly actuated, or pivoted, by hand without a cable. It is preferable to apply the lifting force to the armrest adjacent or proximate the bar member so as to reduce the binding force between the base portion and the bar member. When applying the lifting force at the forward portion of the arm distal of the bar member, low friction bearing surfaces applied to one or more of the armrest and/or bar member can facilitate the adjustment operation.

In yet another embodiment shown in FIG. 52, the armrest includes a pair of pins which ride in a slot 394 formed in the upright. The upper pin 390 engages a rack 388 formed in the upright. In operation, the armrest is lifted upwardly to disengage the upper pin. The armrest is then moved to the desired position where it is released so that the upper pin once again engages the rack.

Figure 51:
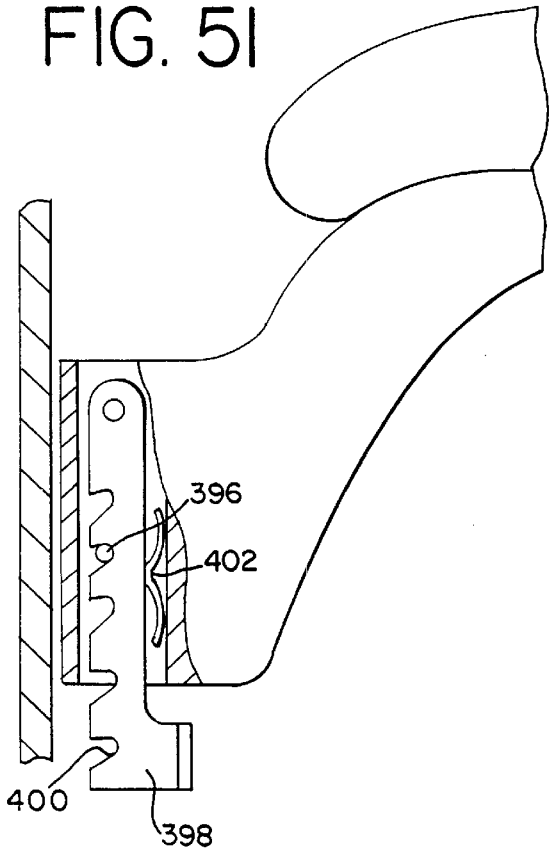
FIG. 51 is an alternative embodiment of the locking device for the armrest.

In yet another embodiment shown in FIG. 51, a laterally extending pin 396 is mounted to the upright. The base portion of the armrest includes a pivot member 398 having a rack 400 formed in a rear surface thereof. The pivot member 398 is pivoted forwardly against the biasing force of a spring 402 mounted in the base portion to release the rack from the pin after which the armrest can be moved to the desired position. The pivot member is then released such that the spring 402 biases the pivot member 398 and rack into engagement with the pin.

Although a number of alternative embodiments of the locking mechanism for the armrest have been shown and described, it should be understood by one of skill in the art that various combinations of racks, wedges, levers and/or springs not specifically described herein would also work.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. An adjustable backrest for a seating structure comprising:

an upright comprising a rack;

said backrest moveably mounted on said upright;

a pawl pivotally mounted to said backrest about a pivot axis, wherein said pawl is pivotable between an engaged position wherein said pawl is engaged with said rack and a disengaged position wherein said pawl is disengaged from said rack, wherein said pawl is further translatably mounted to said backrest, wherein said pawl is translatable relative to said backrest between at least a disabled position and an operative position; and a spring biasing said pawl into said engaged position when said pawl is in said operative position wherein said backrest comprises an elongated first track, wherein said pawl is pivotally mounted to said backrest within said first track and is further translatable within said first track, and a second track having a first portion substantially parallel to said first track and a second portion communicating with said first portion and extending transverse to said first portion, wherein said pawl comprises a guide member traveling within said first and second portions of said second track, wherein said guide member is disposed in said first portion when in said disabled position.

2. The adjustable backrest of claim 1 wherein said upright comprises first and second positioning members located adjacent opposite ends of said rack, wherein said first positioning member engages said pawl and moves said pawl from said operative position to said disabled position, and wherein said second positioning member engages said pawl and moves said pawl from said disabled position to said operative position.

3. The adjustable backrest of claim 2 wherein said first positioning member biases said guide member from said second portion of said second track into said first portion of said second track and translates said guide member in a first direction within said first portion of said second track and translates said pawl within said first track, and wherein said second positioning member translates said pawl in a second direction opposite said first direction within said first track and translates said guide member in said second direction within said first portion of said second track, and wherein said spring biases said guide member from said first portion of said second track to said second portion of said track and into said operative position.

4. The adjustable backrest of claim 1 wherein said backrest comprises a bracket defining said first and second tracks.

5. The adjustable backrest of claim 1 wherein said first and second tracks are formed as slots.

6. The adjustable backrest of claim 1 wherein said pawl comprises a pivot member pivotally engaging said backrest.

7. The adjustable backrest of claim 1 wherein said upright comprises a bar, wherein said backrest is slideably mounted on said bar.

8. The adjustable backrest of claim 1 wherein said pawl is prevented from being pivoted between said engaged and disengaged positions when in said disabled position.

9. An adjustable backrest for a seating structure comprising:

an upright comprising a rack;

said backrest moveably mounted on said upright;

a pawl pivotally mounted to said backrest about a pivot axis, wherein said pawl is pivotable between an engaged position wherein said pawl is engaged with said rack and a disengaged position wherein said pawl is disengaged from said rack, wherein said pawl is further translatably mounted to said backrest, wherein said pawl is translatable relative to said backrest between at least a disabled position and an operative position; and a spring biasing said pawl into said engaged position when said pawl is in said operative position;

wherein said upright comprises a first upright, wherein said pawl comprises a first pawl and wherein said spring comprises a first spring, and further comprising a second upright comprising a second rack, wherein said backrest is moveably mounted on said first and second uprights, a second pawl pivotally mounted to said backrest about a second pivot axis, wherein said second pawl is pivotable between a second engaged position wherein said second pawl is engaged with said second rack and a second disengaged position wherein said second pawl is disengaged from said second rack, wherein said second pawl is further translatably mounted to said backrest, wherein said second pawl is translatable relative to said backrest between at least a second disabled position and a second operative position, and a second spring biasing said second pawl into said second engaged position when said second pawl is in said second operative position.

10. A method for adjusting the height of a backrest on a seating structure comprising:

moving a backrest in a first direction on an upright to a desired height, wherein said backrest comprises an elongated first track and a second track having a first portion substantially parallel to said first track and a second portion communicating with said first portion and extending transverse to said first portion;

engaging a rack on said upright with a pawl moveably mounted to said backrest and thereby releasably securing said backrest at said desired height, wherein said pawl and said rack permit movement of said backrest in only said first direction, wherein said pawl comprises a guide member traveling within said first and second portions of said second track;

releasably securing said pawl in a disabled position by pivoting said pawl relative to said backrest in said first track while moving said guide member in said second portion in said second track, and thereafter translating said pawl in said first track in a first direction and translating said guide member in said first portion of said second track in said first direction;

moving said backrest in a second direction opposite said first direction to a release position; and releasing said pawl from said disabled position when said backrest is in said release position.

11. The method of claim 10 wherein said pivoting said pawl and said translating said pawl and said guide member comprises engaging said guide member with a positioning member disposed on said upright.

12. The method of claim 11 wherein said positioning member comprises a first positioning member and wherein said releasing said pawl from said disabled position comprises engaging said guide member with a second positioning member and translating said pawl in said first track in a second direction opposite said first direction and translating said guide member in said first portion of said second track in said second direction, and biasing said pawl with a spring and thereby moving said guide member in said second portion of said second track to said operative position.

13. The method of claim 10 wherein said first and second tracks are formed as slots.

* * * * *